US009211739B2

(12) United States Patent
Ozaki

(10) Patent No.: US 9,211,739 B2
(45) Date of Patent: Dec. 15, 2015

(54) MEDIUM-HOLDING DEVICE, MEDIUM-CONVEYING DEVICE, AND INKJET RECORDING DEVICE

(71) Applicant: FUJIFILM Corporation, Tokyo (JP)

(72) Inventor: Takao Ozaki, Ashigarakami-gun (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 14/600,490

(22) Filed: Jan. 20, 2015

(65) Prior Publication Data

US 2015/0138294 A1 May 21, 2015

Related U.S. Application Data

(63) Continuation of application No. PCT/JP2013/069783, filed on Jul. 22, 2013.

(30) Foreign Application Priority Data

Jul. 24, 2012 (JP) ..... 2012-163900

(51) Int. Cl.
*B41J 2/01* (2006.01)
*B41J 13/22* (2006.01)
*B65H 5/12* (2006.01)

(52) U.S. Cl.
CPC *B41J 13/226* (2013.01); *B65H 5/12* (2013.01)

(58) Field of Classification Search
CPC ..... B41J 2/01; B41J 13/0027; B41J 13/226; B41J 11/0085
USPC ..... 347/104
See application file for complete search history.

(56) References Cited

U.S. PATENT DOCUMENTS 6,612,236 B2 * 9/2003 Frankenberger et al. ..... 101/232
2002/0046667 A1 4/2002 Frankenberger et al.

(Continued)

FOREIGN PATENT DOCUMENTS

JP H01-99630 U 7/1989
JP 2002-128315 A 5/2002

(Continued)

OTHER PUBLICATIONS

Notification of Transmittal of Translation of The International Preliminary Report on Patentability and Translation of Written Opinion of the International Searching Authority; PCT/JP2013/069783 issued on Feb. 5, 2015.

(Continued)

*Primary Examiner* — Alessandro Amari
*Assistant Examiner* — Michael Konczal
(74) *Attorney, Agent, or Firm* — Studebaker & Brackett PC

(57) ABSTRACT

The present invention provides a medium-holding device capable of setting a suction pressure for each of various areas within a suction-holding surface, a medium-conveying device, and an inkjet recording device. In an embodiment of the invention, a cover is attached to a main body formed into a drum shape such that a surface of the cover functions as the suction-holding surface for a paper sheet. The cover has a plurality of suction apertures formed thereon from which suction apertures the paper sheet on the suction-holding surface is sucked. The suction apertures are arranged at a certain pitch. A specific suction aperture of them has a narrowing member attached thereto. The suction aperture having the narrowing member attached thereto has the suction pressure lowered. Therefore, by adjusting an arrangement of the specific suction aperture having the narrowing member attached thereto, the suction pressure can be partially controlled within the suction-holding surface.

16 Claims, 19 Drawing Sheets

(56) References Cited

U.S. PATENT DOCUMENTS

2010/0177152 A1 7/2010 Fukui
2012/0019606 A1* 1/2012 Fukui ..... 347/104

FOREIGN PATENT DOCUMENTS

JP 2010-158812 A 7/2010
JP 2012-024990 A 2/2012

OTHER PUBLICATIONS

International Search Report; PCT/JP2013/069783; Sep. 17, 2013.
An Office Action; "Notification of Reasons for Rejection," issued by the Japanese Patent Office on Jun. 3, 2015, which corresponds to Japanese Patent Application No. 2012-163900 and is related to U.S. Appl. No. 14/600,490; with English language partial translation.

* cited by examiner

BEFORE SUCKING

AFTER START OF SUCKING, DURING ROLLER SQUEEZE

BEFORE SUCKING

AFTER START OF SUCKING, BEFORE ROLLER SQUEEZE

AFTER START OF SUCKING, DURING ROLLER SQUEEZE

MEDIUM-HOLDING DEVICE, MEDIUM-CONVEYING DEVICE, AND INKJET RECORDING DEVICE

CROSS-REFERENCE TO RELATED APPLICATIONS

This application is a Continuation of PCT International Application No. PCT/JP2013/069783 filed on Jul. 22, 2013, which claims priority under 35 U.S.C. §119(a) to Japanese Patent Application No. 2012-163900 filed on Jul. 24, 2012. Each of the above application(s) is hereby expressly incorporated by reference, in its entirety, into the present application.

BACKGROUND OF THE INVENTION

1. Field of the Invention

The present invention relates to a medium-holding device, a medium-conveying device, and an inkjet recording device, and particularly to a technology for holding a sheet-shaped medium by suction on a suction-holding surface.

2. Description of the Related Art

An inkjet recording device has been known as a device for recording an image on a sheet-shaped medium. The inkjet recording device ejects and deposits ink droplets onto a medium from a nozzle provided in a head to record an image on the medium.

In the inkjet recording device, a region of the medium facing a nozzle region in the head has to be kept flat during printing. If the medium is wavy, a distance to the nozzle varies such that the ink droplet is not placed at a desired position on the medium to deteriorate image quality. For this reason, the inkjet recording device frequently employs a conveyance form of holding a medium by suction as conveying means for conveying a medium.

For example, PTL 1 (Japanese Patent Application Laid-Open No. 2010-158812) proposes that a suction pressure is varied and set for each region in order to stably hold also a stiff medium, such as thick paper, by suction. In PTL1, since the suction pressure is varied and set for each region, the suction pressure in each region is adjusted by adjusting a width, a length or the like of a suction groove connected to suction apertures provided in each region.

PTL 2 (Japanese Utility Model Laid-Open No. 1-99630) proposes that a suction pressure in each region is adjusted by making a diameter of a suction aperture in a region in which a suction pressure is to be increased larger than a diameter of a suction aperture in other region.

SUMMARY OF THE INVENTION

However, PTL 1 has a defect that the suction pressure cannot be set for more minute sections since the suction pressure is set in a unit of suction groove.

Moreover, PTL 2 has a defect that of ratio of an area of suction apertures to an area of suction is made varied since the radiuses of the respective suction apertures are varied.

The present invention has been made in consideration of such a circumstance, and has an object to provide a medium-holding device, a medium-conveying device, and an inkjet recording device capable of arbitrarily setting a suction pressure for each region within a suction-holding surface.

A solution to the above problems is as follows.

A first aspect is a medium-holding device holding a sheet-shaped medium by suction, including, a main body having a sucking part, a sucking which sucks an inner side of the sucking part, a sheet-shaped cover which is attached to the main body and covers the sucking part to configure a suction-holding surface of the medium, a plurality of suction apertures formed to have the same diameter on the cover, and a narrowing member individually provided to a specific suction aperture of the plurality of suction apertures for narrowing the specific suction aperture, the narrowing member including a narrowing flow path which is provided on a back surface of the cover and in communication with the specific suction aperture to narrow the specific suction aperture.

According to the aspect, the surface of the cover attached to the main body functions as the suction-holding surface of the medium. When the sucking part formed in the main body is sucked by a suction device, air is sucked from the suction apertures formed on the cover. The medium is placed on the suction-holding surface and the inner side of the sucking part is sucked by the suction device to hold the medium by suction by the suction-holding surface.

The cover has a plurality of suction apertures formed some of which suction apertures (specific suction apertures) are provided with the narrowing member. The narrowing member has a function to narrow these specific suction apertures. In the narrowed specific suction apertures, a flow rate is lowered resulting to the lowered suction pressure. Therefore, by adjusting a layout of the specific suction apertures provided with the narrowing member, the suction pressure can be partially adjusted within the suction-holding surface. The narrowing member is individually provided to the specific suction aperture such that the suction pressure can be minutely controlled. Since the narrowing member is provided on the back surface of the cover and a diameter of the suction aperture itself is not changed, a ratio of an area of the suction apertures to the suction-holding surface (ratio of the opening portions) is not changed. In other words, in case where the diameter of the suction aperture is merely changed, the ratio of the area of the suction apertures to the suction-holding surface is changed, but in the aspect, the ratio of the area of the suction apertures is not changed. This facilitates design of suction.

A second aspect is an aspect that, in the medium-holding device of the above first aspect, the narrowing flow path of the narrowing member is formed to open in a direction different from a formation direction of the specific suction aperture.

According to the aspect, the narrowing flow path is formed to open in a direction different from the formation direction of the suction aperture. This allows a length of the narrowing flow path to be adjusted in a compact configuration. In other words, in a case where the narrowing flow path is made longer, if the narrowing flow path is formed in a direction the same as the formation direction of the suction aperture, a thickness of the whole cover is thickened. On the other hand, as in the aspect, the narrowing flow path is formed to open in a direction different from the formation direction of the suction aperture such that the thickness of the whole cover can be suppressed and the length of the narrowing flow path can be adjusted. Particularly, in a case of increasing the narrowing effect, the flow path has to be made thinner and narrower, and thus, the aspect effectually acts.

A third aspect is an aspect that, in the medium-holding device of the above first or second aspect, the narrowing member abuts on the main body when the cover is attached to the main body.

According to the aspect, when the cover is attached to the main body, the narrowing member abuts on the main body. This can make the narrowing member function as a supporting part of the cover, preventing the cover formed into a sheet shape from deforming.

A fourth aspect is an aspect that, in the medium-holding device of the above first aspect, the narrowing member includes a narrowing member main body having an abutment face on which the main body abuts, a communication hole formed to penetrate from the abutment face of the narrowing member main body to the specific suction aperture and formed concentrically with the specific suction aperture to have a diameter the same as the specific suction aperture, and a groove formed on the abutment face of the narrowing member main body and having one end formed to open on an outer peripheral surface of the narrowing member main body and the other end formed to open on an inner peripheral surface of the communication hole, in which the abutment face of the narrowing member main body abuts on the main body such that an opening portion of the communication hole formed on the abutment face is blocked by the main body, and the narrowing flow path is defined by an opening portion of the groove formed on the abutment face and the main body.

According to the aspect, the narrowing member is configured to include the narrowing member main body, the communication hole formed in the narrowing member main body, and the groove formed in the narrowing member main body. The communication hole is formed to have a diameter the same as the specific suction aperture to which the narrowing member is provided, and is formed concentrically with the specific suction aperture so as to be in communication with the specific suction aperture. The groove has one end formed to open on the outer peripheral surface of the narrowing member main body and the other end formed to open on the inner peripheral surface of the communication hole. The narrowing member main body abuts on main body when the cover is attached to the main body. When the abutment face of the narrowing member main body abuts on the main body, the opening portion of the communication hole formed on the abutment face is blocked by the main body. The narrowing flow path is defined by the opening portion of the groove formed on the abutment face and the main body. The narrowing flow path is formed to open in a direction different from the formation direction of the suction aperture, allowing the length of the narrowing flow path to be adjusted in a compact configuration. The narrowing member main body which abuts on the main body is allowed to function as the supporting part of the cover.

A fifth aspect is an aspect that, in the medium-holding device of the above fourth aspect, a plurality of the grooves are formed radially from the communication hole as a center.

According to the aspect, a plurality of the grooves are formed radially from the communication hole as a center. The number of the groove is adjusted to be able to adjust the number of the narrowing flow paths to be formed. This enables the narrowing effect given by the narrowing member to be easily adjusted.

A sixth aspect is an aspect that, in the medium-holding device of the above fourth aspect, the groove has an expansion area having an expanded width in an intermediate portion thereof.

According to the aspect, the expansion area having an expended width is formed in the middle of the groove. This can give the orifice effect to allow a narrowing effect to increase at a large flow rate.

A seventh aspect is an aspect that, in the medium-holding device of the above first aspect, the narrowing member includes a tubularly-shaped inner tubular part arranged concentrically with the specific suction aperture in which an inner periphery has a diameter the same as the specific suction aperture, and the inner periphery is in communication with the specific suction aperture, an inner tubular cutout formed by cutting out a part of a wall surface of the inner tubular part, a tubularly-shaped outer tubular part arranged concentrically with the inner tubular part in which an inner periphery has a diameter larger than an outside diameter of the inner tubular part, and a certain gap is defined between the outer tubular part and the inner tubular part, and an outer tubular cutout formed by cutting out a part of a wall surface of the outer tubular part, in which ends of the inner tubular part and the outer tubular part abut on the main body such that the inner periphery of the inner tubular part and the inner periphery of the outer tubular part are blocked by the main body, and the narrowing flow path is defined between the inner tubular part and the outer tubular part.

According to the aspect, the narrowing member is formed in a so-called double tube structure. The inner tubular part on the inner side is formed such that an inner periphery thereof has a diameter the same as the diameter of the suction aperture and arranged concentrically with the specific suction aperture. The outer tubular part is arranged around an outer periphery of the inner tubular part to define a predetermined gap (flow path) between the outer tubular part and the inner tubular part. The inner tubular part has an inner tubular cutout formed on a part of a wall surface thereof, and the outer tubular part also has an outer tubular cutout formed on a part of a wall surface thereof. When the cover is attached to the main body, ends of the inner tubular part and the outer tubular part abut on the main body which blocks the inner periphery of the inner tubular part and the inner periphery of the outer tubular part. At the same time as this, the narrowing flow path is formed between the inner tubular part and the outer tubular part. The narrowing flow path is formed to open in a direction different from the formation direction of the suction aperture, allowing the length of the narrowing flow path to be adjusted in a compact configuration. Particularly, forming into an arc-shape can provide the narrowing member which is compact and has high narrowing effect. The narrowing member main body which abuts on the main body is allowed to function as the supporting part of the cover.

An eighth aspect is an aspect that, in the medium-holding device of any one of the above first to seventh aspects, the cover is detachably attached to the main body.

According to the aspect, the cover is detachably attached to the main body. This allows the suction pressure to be changed by changing to the cover different in the arrangement of the specific suction apertures.

A ninth aspect is an aspect that, in the medium-holding device of the above eighth aspect, a plurality of the covers different from each other in the arrangement of the specific suction apertures are provided in advance.

According to the aspect, a plurality of the covers different from each other in the arrangement of the specific suction apertures are provided in advance. This allows the suction pressure to be easily changed.

A tenth aspect is an aspect that, in the medium-holding device of any one of the above first to ninth aspects, the suction apertures are arranged longitudinally and transversely on the suction-holding surface, and the suction apertures other than the specific suction aperture are repeatedly arranged longitudinally and transversely on the suction-holding surface.

According to the aspect, the suction apertures are arranged longitudinally and transversely on the suction-holding surface. Then, of the arranged suction apertures, the suction apertures other than the specific suction apertures are repeatedly arranged longitudinally and transversely on the suction-holding surface. For example, the suction-holding surface is divided at a certain ratio longitudinally and transversely (e.g., three divisions longitudinally/four divisions transversely, four division longitudinally and transversely), and each divided area has the specific suction apertures arranged in the same pattern. The suction apertures other than the specific suction aperture (i.e., the suction aperture not having the narrowing member) have the suction pressure higher than that of the specific suction aperture (that is, the suction aperture having the narrowing member). Therefore, according to the aspect, the suction aperture having the higher suction pressures is repeatedly arranged longitudinally and transversely. By doing so, for example, when the medium is nipped by the roller to be brought into in tight contact with the suction-holding surface, the medium can be held by suction on the suction-holding surface with elongation of the medium being finely divided. This allows the medium to be held by suction without creasing even if the medium partially having the elongation is held by suction. In the aspect, the pattern of the suction aperture arrangement and the pitch/period for repeat may be the same on all over the suction-holding surface or may be different from other areas of the suction-holding surface. Similarly, the pitch/period for the arrangement may be the same longitudinally and transversely on the suction-holding surface or may be different. These conditions are similar under the aspects of the present invention below.

An eleventh aspect is an aspect that, in the medium-holding device of the above tenth aspect, the suction apertures other than the specific suction aperture are arranged in a frame and repeatedly arranged longitudinally and transversely on the suction-holding surface.

According to the aspect, the suction apertures other than the specific suction aperture are arranged in a frame and repeatedly arranged longitudinally and transversely on the suction-holding surface. The suction apertures other than the specific suction aperture are the suction apertures not having the narrowing member and the suction apertures having higher suction pressure. In other words, in the aspect, the suction apertures having higher suction pressure are arranged in a frame and repeatedly arranged longitudinally and transversely on the suction-holding surface. This allows the medium to be held by suction without creasing even if the medium partially having the elongation is held by suction.

A twelfth aspect is an aspect that, in the medium-holding device of the above tenth aspect, the suction apertures other than the specific suction aperture are arranged in clusters and repeatedly arranged longitudinally and transversely on the suction-holding surface.

According to the aspect, the aspect is that the suction apertures other than the specific suction aperture are arranged in clusters and repeatedly arranged longitudinally and transversely on the suction-holding surface. The suction apertures other than the specific suction aperture are the suction apertures not having the narrowing member and the suction apertures having higher suction pressure. In other words, in the aspect, the suction apertures having higher suction pressure are arranged in clusters and repeatedly arranged longitudinally and transversely on the suction-holding surface. This allows the medium to be held by suction without creasing even if the medium partially having the elongation is held by suction.

A thirteenth aspect is an aspect that, in the medium-holding device of any one of the above first to ninth aspects, the suction apertures are arranged longitudinally and transversely on the suction-holding surface, and the suction apertures other than the specific suction aperture are arranged at both end parts in a longitudinal direction and/or a transverse direction on the suction-holding surface.

According to the aspect, the suction apertures are arranged longitudinally and transversely on the suction-holding surface, and the suction apertures other than the specific suction aperture are arranged at both end parts in the longitudinal direction and/or a transverse direction on the suction-holding surface. The suction apertures other than the specific suction aperture are the suction apertures not having the narrowing member and the suction apertures having higher suction pressure. In other words, in the aspect, the suction apertures having higher suction pressure are arranged at both end parts in the longitudinal direction and/or a transverse direction on the suction-holding surface. This can prevent coming-off at the end parts of the medium. Particularly in a case where the suction-holding surface is formed into an arc-shape, the coming-off is likely to be generated at both ends on the surface of an arc surface, and thus, the aspect effectually acts.

A fourteenth aspect is an aspect that, in the medium-holding device of any one of the above first to ninth aspects, the suction apertures are arranged longitudinally and transversely on the suction-holding surface, and a ratio of the suction apertures other than the specific suction aperture is increased stepwise from the center of the suction-holding surface toward both end parts in a longitudinal direction and/or a transverse direction on the suction-holding surface.

According to the aspect, the suction apertures are arranged longitudinally and transversely on the suction-holding surface, and a ratio of the suction apertures other than the specific suction aperture is increased stepwise from the center of the suction-holding surface toward both end parts in a longitudinal direction and/or a transverse direction on the suction-holding surface. The suction apertures other than the specific suction aperture are the suction apertures not having the narrowing member and the suction apertures having higher suction pressure. In other words, in the aspect, a ratio of the suction apertures having higher suction pressure is increased stepwise from the center of the suction-holding surface toward both end parts in a longitudinal direction and/or a transverse direction on the suction-holding surface. This can prevent coming-off at the end parts of the medium. Particularly in a case where the suction-holding surface is formed into an arc-shape, the coming-off is likely to be generated at both ends on the surface of an arc surface, and thus, the aspect effectually acts.

A fifteenth aspect is an aspect that the medium-holding device of any one of the above first to fourteenth aspects further includes a roller rolling and moving relatively on the suction-holding surface to nip the medium held by suction by the suction-holding surface between the roller and the suction-holding surface.

According to the aspect, the medium is pressed by the roller. This can bring the medium into tight contact with the suction-holding surface, further effectively preventing occurrence of creasing of the medium.

A sixteenth aspect is a medium-conveying device including the medium-holding device of any one of the above first to fifteenth aspects, and a driving device which drives the main body of the medium-holding device to move the suction-holding surface.

According to the aspect, the medium can be conveyed by holding by suction in a state without coming-off or creasing.

A seventeenth aspect is an aspect that, in the medium-conveying device of the above sixteenth aspect, the main body is formed into a drum shape, and the suction-holding surface is formed on the outer peripheral surface.

According to the aspect, the medium is held by suction in a state of being wound on the peripheral surface of the main body formed in a drum shape. Then, the medium is conveyed by rotating the main body.

An eighteenth aspect is an inkjet recording device including the medium-conveying device of the above sixteenth or seventeenth aspect, and an inkjet head ejecting and depositing an ink toward the medium being conveyed by the medium-conveying device to render an image on the medium.

According to the aspect, droplets of ink can be deposited onto the medium being conveyed in a state without coming-off or creasing, allowing a high quality image to be recorded.

According to the present invention, a suction pressure for each region within a suction-holding surface can be arbitrarily set.

DETAILED DESCRIPTION OF THE EMBODIMENTS

Hereinafter, a description is given for a preferred embodiment for carrying out the present invention with reference to the accompanying drawings.

<<General Configuration of Inkjet Recording Device>>

First, a description is given for a general configuration of an inkjet recording device.

Figure 1:
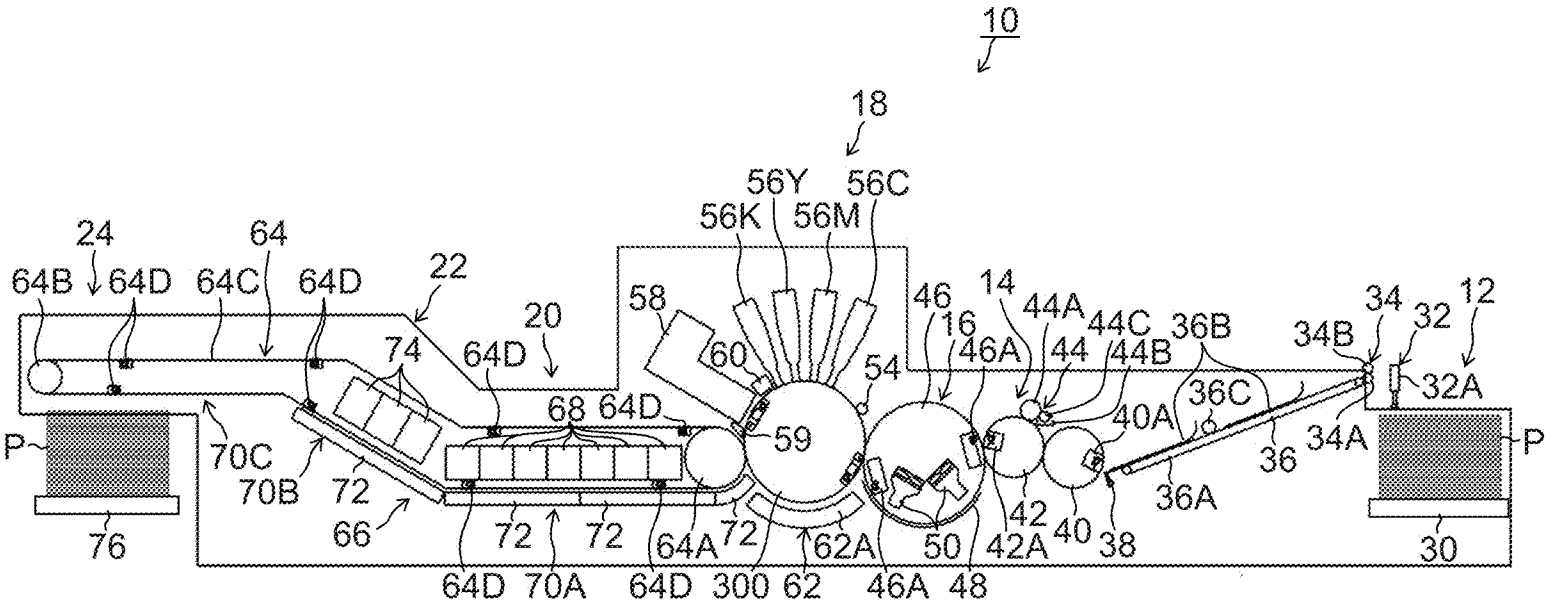
FIG. 1 is a general configuration diagram illustrating an overall schematic configuration of an inkjet recording device.

FIG. 1 is a general configuration diagram illustrating an overall schematic configuration of an inkjet recording device.

This inkjet recording device 10 records a color image on a printer sheet by depositing droplets of ink of four colors, cyan (C), magenta (M), yellow (Y), and black (K). A general purpose printing sheet is used for the printer sheet as a medium. An ultraviolet-curable aqueous ink is used for the ink.

Here, the general purpose printing sheet is not so-called inkjet paper but paper such as coated paper mainly made from cellulose which is used for general offset printing or the like. The aqueous ink is an ink obtained by dissolving or dispersing coloring materials such as dye or pigment in water or in a solvent soluble in water. The ultraviolet-curable aqueous ink is a type of aqueous ink cured by being irradiated with ultraviolet rays.

When an image is recorded on the general purpose printing sheet using the aqueous ink by inkjet printing, curling, cockling (waving) or the like occur. For this reason, the inkjet recording device in this embodiment performs recording of an image after preliminary application of a treatment liquid which has a function of aggregating components in the ink.

As shown in FIG. 1, the inkjet recording device 10 is configured to mainly include a paper feed unit 12 for feeding a paper sheet P as a medium, a treatment liquid application unit 14 for applying the treatment liquid onto a surface (image record surface) of the paper sheet P fed from the paper feed unit 12, a treatment liquid drying treatment unit 16 for subjecting the paper sheet P applied with the treatment liquid to a drying treatment, an image recording unit 18 for depositing ink droplets by inkjet printing on the surface of the paper sheet P subjected to the drying treatment for rendering an color image, a drying treatment unit 20 for subjecting the paper sheet P having the image recorded thereon to a drying treatment, an ultraviolet irradiation unit 22 for irradiating the paper sheet P subjected to the drying treatment with ultraviolet (UV) rays to fix the image, and a paper discharge unit 24 for discharging the paper sheet P irradiated with the ultraviolet rays for collecting.

<Paper Feed Unit>

The paper feed unit 12 feeds the paper sheets P stacked on a paper feed platform 30 one by one to the treatment liquid application unit 14. The paper feed unit 12 is configured to mainly include the paper feed platform 30, a sucker (sucking device) 32, a paper feed roller pair 34, a feeder board 36, a front stop 38, and, a paper feed drum 40.

The paper sheet P is placed on the paper feed platform 30 in a state of a stack in which plenty of sheets are piled up. The paper feed platform 30 is provided so as to be capable of being lifted and lowered by a paper feed platform lifting and lowering device (not shown). The paper feed platform lifting and lowering device is controlled to be driven in conjunction with increase and decrease of the paper sheets P stacked on the paper feed platform 30 to lift and lower the paper feed platform 30 such that the paper sheet P placed on the top of the stack is always positioned at a certain height.

As described above, the inkjet recording device 10 in this embodiment uses the general purpose printing sheet for the paper sheet (printer sheet) P as a medium.

The sucker (sucking device) 32 takes the paper sheets P stacked on the paper feed platform 30 sequentially from the top one by one to feed to the paper feed roller pair 34. The sucker (sucking device) 32, which includes a suction foot 32A provided liftably and swingably, holds a top surface of the paper sheet P by suction by the suction foot 32A to transport the paper sheet P from the paper feed platform 30 to the paper feed roller pair 34 (roller). At this time, the suction foot 32A holds a leading end side of the top surface of the paper sheet P placed on the top of the stack by suction to lift the paper sheet P and insert a leading end of the lifted paper sheet P between a pair of rollers 34A and 34B (roller) included in the paper feed roller pair 34.

The paper feed roller pair 34 includes the vertical pair of rollers 34A and 34B which are pressed and abutted against each other. The vertical pair of rollers 34A and 34B has a driving roller (roller 34A) as one of the pair and a driven roller (roller 34B) as the other. The driving roller (roller 34A) is driven by a motor (not shown) to be rotated. The motor is driven in conjunction of feeding of the paper sheet P so as to rotate the driving roller (roller 34A) at a timing when the paper sheet P is fed from the sucker (sucking device) 32. The paper sheet P inserted between the vertical pair of rollers 34A and 34B is nipped by the rollers 34A and 34B to be fed in a rotation direction of the rollers 34A and 34B (direction in which the feeder board 36 is arranged).

The feeder board 36, which is formed corresponding to a paper width, receives the paper sheet P fed from the paper feed roller pair 34 and guides to the front stop 38. The feeder board 36 is arranged so that the leading end side thereof is inclined downward, and slides the paper sheet P placed on a conveying surface of the feeder board 36 to guide to the front stop 38 along the conveying surface.

The feeder board 36 is provided with a plurality of tape feeders 36A arranged at intervals in a width direction for conveying the paper sheet P. The tape feeder 36A is formed to have no ends and driven by a motor (not shown) to be rotated. The paper sheet P placed on the conveying surface of the feeder board 36 is given a feed by the tape feeder 36A to be conveyed on the feeder board 36.

On the feeder board 36, a retainer 36B and a rolling member 36C are arranged.

A plurality of retainers 36B (two in the example) are arranged in tandem, front and back, along a conveying surface of the paper sheet P. The retainer 36B includes a leaf spring having a width corresponding to the paper width, and arranged to be pressed and abutted against the conveying surface. The paper sheet P being conveyed on the feeder board 36 by the tape feeder 36A is passed through the retainer 36B to correct irregularity thereof. The retainer 36B is formed to have a trailing end curled in order to easily insert the paper sheet P between the feeder board 36 and the retainer 36B.

The rolling member 36C is arranged between the front and back retainers 36B. The rolling member 36C is arranged so as to be pressed and abutted against the conveying surface of the paper sheet P. The paper sheet P being conveyed between the front and back retainers 36B is conveyed with the top surface being held by the rolling member 36C.

The front stop 38 corrects an attitude of the paper sheet P. The front stop 38 is formed into a plate-shape and arranged perpendicularly to a conveying direction of the paper sheet P. The front stop 38 is arranged swingably to be driven by a motor (not shown). The paper sheet P conveyed on the feeder board 36, whose leading end is abutted against the front stop 38, is corrected in attitude (so-called skew prevention). The front stop 38 swings in conjunction with feeding the paper sheet to the paper feed drum 40 to pass the paper sheet P corrected in attitude to the paper feed drum 40.

The paper feed drum 40 receives the paper sheet P fed from the feeder board 36 via the front stop 38 to convey to the treatment liquid application unit 14. The paper feed drum 40 is formed into a cylindrical shape and driven by a motor (not shown) to be rotated. The paper feed drum 40 has a gripper 40A provided on an outer peripheral surface thereof, and the gripper 40A grips the leading end of the paper sheet P. The paper feed drum 40 rotates with gripping the leading end of the paper sheet P by the gripper 40A to wind the paper sheet P on the peripheral surface while conveying the paper sheet P to the treatment liquid application unit 14.

The paper feed unit 12 is configured as described above. The paper sheets P stacked on the paper feed platform 30 are lifted by the sucker (sucking device) 32 sequentially from the top one by one to be fed to the paper feed roller pair 34. The paper sheet P fed to the paper feed roller pair 34 is fed forward by the vertical pair of rollers 34A and 34B included in the paper feed roller pair 34 to be placed on the feeder board 36. The paper sheet P placed on the feeder board 36 is conveyed by the tape feeder 36A provided on the conveying surface of feeder board 36. In this conveying course, the paper sheet P is pressed against the conveying surface of the feeder board 36 by the retainer 36B to correct irregularity. The paper sheet P conveyed by the feeder board 36 abuts on the front stop 38 at the leading end thereof to be corrected in inclination, and thereafter, passed to the paper feed drum 40. Then, the paper feed drum 40 conveys the paper sheet P to the treatment liquid application unit 14.

<Treatment Liquid Application Unit>

The treatment liquid application unit 14 deposits the treatment liquid onto a surface of the paper sheet P (image record surface). The treatment liquid application unit 14 is configured to mainly include a treatment liquid deposition drum 42 for conveying the paper sheet P and a treatment liquid deposition unit 44 for depositing a predetermined treatment liquid onto a printing surface of the paper sheet P being conveyed by the treatment liquid deposition drum 42.

The treatment liquid deposition drum 42 receives the paper sheet P from the paper feed drum 40 in the paper feed unit 12 to convey the paper sheet P to the treatment liquid drying treatment unit 16. The treatment liquid deposition drum 42 is formed into a cylindrical shape and driven by a motor (not shown) to be rotated. The treatment liquid deposition drum 42 has a gripper 42A on an outer peripheral surface thereof, and the gripper 42A grips the leading end of the paper sheet P. The treatment liquid deposition drum 42 rotates with gripping the leading end of the paper sheet P by the gripper 42A to wind the paper sheet P on the peripheral surface while conveying the paper sheet P to the treatment liquid drying treatment unit 16 (one paper sheet P is conveyed per one rotation). The treatment liquid deposition drum 42 and the paper feed drum 40 are controlled to be rotated such that their timings of receiving and passing the paper sheet P coincide with each other. In other words, these drums are driven to have the same circumferential speed and driven such that positions of their grippers match each other.

The treatment liquid deposition unit 44 applies the treatment liquid by roller onto the surface of the paper sheet P being conveyed by the treatment liquid deposition drum 42. The treatment liquid deposition unit 44 is configured to mainly include an application roller 44A for applying the treatment liquid onto the paper sheet P, a treatment liquid tank 44B for reserving the treatment liquid, and a drawing roller 44C for drawing the treatment liquid reserved in the treatment liquid tank 44B to supply to the application roller 44A. The drawing roller 44C is arranged to be pressed and abutted against the application roller 44A and arranged to have a part thereof immersed in the treatment liquid reserved in the treatment liquid tank 44B. The drawing roller 44C measures and draws the treatment liquid to deposit the treatment liquid of a certain thickness onto a peripheral surface of application roller 44A. The application roller 44A is provided corresponding to the paper width, and pressed and abutted against the paper sheet P to apply the treatment liquid deposited onto the peripheral surface thereof onto the paper sheet P. The application roller 44A is driven by an abutting and separation mechanism (not shown) to be moved between an abutting position where to abut the peripheral surface of the treatment liquid deposition drum 42 and a separating position where to separate from the peripheral surface of the treatment liquid deposition drum 42. The abutting and separation mechanism moves the application roller 44A at a timing when the paper sheet P is passing and applies the treatment liquid onto the surface of the paper sheet P being conveyed by the treatment liquid deposition drum 42.

Note that in this example, the configuration is such that the treatment liquid is applied by roller, but a method for depositing the treatment liquid is not limited thereto. Other than this configuration, a configuration in which deposition is carried out by use of an inkjet head or a configuration in which deposition is carried out by spraying may be also employed.

The treatment liquid application unit 14 is configured as described above. The paper sheet P passed from the paper feed drum 40 in the paper feed unit 12 is received by the treatment liquid deposition drum 42. The treatment liquid deposition drum 42 rotates with gripping the leading end of the paper sheet P by the gripper 42A to wind the paper sheet P on the peripheral surface for conveying. In this conveying course, the application roller 44A is pressed and abutted against the surface of the paper sheet P to apply the treatment liquid onto the surface of the paper sheet P.

Note that the treatment liquid applied by the treatment liquid application unit 14 is a treatment liquid which has a function of aggregating components in the ink (coloring material in this embodiment) as described above. Application of such a treatment liquid onto the surface of the paper sheet P before ink droplets deposition allows an image of high quality to be recorded even in a case where the aqueous ink is used to record an image on the general purpose printing sheet.

<Treatment Liquid Drying Treatment Unit>

The treatment liquid drying treatment unit 16 subjects the paper sheet P having the surface applied with treatment liquid to the drying treatment. This treatment liquid drying treatment unit 16 is configured to mainly include a treatment liquid drying treatment drum 46 for conveying the paper sheet P, a paper conveying guide 48, and a treatment liquid drying treatment unit 50 for blowing hot air to the printing surface, so as to be dried, of the paper sheet P being conveyed by the treatment liquid drying treatment drum 46.

The treatment liquid drying treatment drum 46 receives the paper sheet P from the treatment liquid deposition drum 42 in the treatment liquid application unit 14 to convey the paper sheet P to the image recording unit 18. The treatment liquid drying treatment drum 46 includes a frame member assembled in a cylindrical shape and is driven by a motor (not shown) to be rotated. The treatment liquid drying treatment drum 46 has a gripper 46A on an outer peripheral surface thereof, and the gripper 46A grips the leading end of the paper sheet P. The treatment liquid drying treatment drum 46 rotates with gripping the leading end of the paper sheet P by the gripper 46A to wind the paper sheet P on the peripheral surface while conveying the paper sheet P to the image recording unit 18. Note that the treatment liquid drying treatment drum 46 in this example has the gripper 42A arranged at each of two points on the outer peripheral surface thereof to be configured such that two paper sheets P can be conveyed per one rotation. The treatment liquid drying treatment drum 46 and the treatment liquid deposition drum 42 are controlled to be rotated such that their timings of receiving and passing the paper sheet P coincide with each other. In other words, these drums are driven to have the same circumferential speed and driven such that positions of their grippers match each other The paper conveying guide 48 is arranged along a conveying path of the paper sheet P relating to the treatment liquid drying treatment drum 46 to guide the paper sheet P being conveyed.

The treatment liquid drying treatment unit 50, which is arranged inside the treatment liquid drying treatment drum 46, blows the hot air to the surface of the paper sheet P being conveyed by the treatment liquid drying treatment drum 46 to carry out the drying treatment. This example has a configuration in which two treatment liquid drying treatment units 50 are arranged inside the treatment liquid drying treatment drum and blow the hot air to the surface of the paper sheet P being conveyed by the treatment liquid drying treatment drum 46.

The treatment liquid drying treatment unit 16 is configured as described above. The paper sheet P passed from the treatment liquid deposition drum 42 in the treatment liquid application unit 14 is received by the treatment liquid drying treatment drum 46. The treatment liquid drying treatment drum 46 rotates with gripping the leading end of the paper sheet P by the gripper 46A to convey the paper sheet P. At this time, the treatment liquid drying treatment drum 46 carries out conveying with the surface of the paper sheet P (surface applied with the treatment liquid) facing the inner side. The paper sheet P, in a course of being conveyed by the treatment liquid drying treatment drum 46, is subjected to the drying treatment in which the surface thereof receives the hot air blown from the treatment liquid drying treatment unit 50 arranged inside the treatment liquid drying treatment drum 46. In other words, solvent components in the treatment liquid are removed. This forms an ink aggregation layer on the surface of the paper sheet P.

<Image Recording Unit>

The image recording unit 18 deposits droplets of ink of each of colors C, M, Y, and K onto the printing surface of the paper sheet P to render a color image on the printing surface of the paper sheet P. The image recording unit 18 is configured to mainly include an image recording drum 300 for conveying the paper sheet P, a paper pressing roller 54 for pressing the paper sheet P being conveyed by the image recording drum 300 to bring the paper sheet P into tight contact with a peripheral surface of the image recording drum 300 (medium-holding device, medium-conveying device), inkjet heads 56C, 56M, 56Y, and 56K for ejecting and depositing ink droplets of each of colors C, M, Y, and K onto the paper sheet P, an inline sensor 58 for reading out the image recorded on the paper sheet P, a mist filter 60 for catching ink mist, and a drum cooling unit 62 for cooling the image recording drum 300.

The image recording drum 300 functions as a device holding the paper sheet P as a medium, that is, medium-holding device as well as functions as a device conveying the paper sheet P, that is, medium-conveying device.

The image recording drum 300 receives the paper sheet P from the treatment liquid drying treatment drum 46 in the treatment liquid drying treatment unit 16 to convey the paper sheet P to the an ink drying treatment unit 20. The image recording drum 300 is formed into a cylindrical shape, and driven by a motor (not shown) to be rotated. The image recording drum 300 has a gripper on an outer peripheral surface thereof, and the gripper grips the leading end of the paper sheet P. The image recording drum 300 rotates with gripping the leading end of the paper sheet P by the gripper to wind the paper sheet P on the peripheral surface while conveying the paper sheet P to the ink drying treatment unit 20. The image recording drum 300 has plenty of suction apertures (not shown in FIG. 1) formed on the peripheral surface thereof. The paper sheet P wound on the peripheral surface of the image recording drum 300 is sucked from the suction apertures to be held by suction on the peripheral surface of the image recording drum 300 while being conveyed. This allows the paper sheet P to be conveyed with flatness being highly kept.

Note that the configuration of the image recording drum 300 is described later in more detail.

The paper pressing roller 54 is arranged in the vicinity of a paper receiving position of the image recording drum 300 (position at which the paper sheet P is received from the treatment liquid drying treatment drum 46). The paper pressing roller 54, which is formed of a rubber roller, is arranged to be pressed and abutted against the peripheral surface of the image recording drum 300. The paper sheet P passed from the treatment liquid drying treatment drum 46 to the image recording drum 300 is passed through the paper pressing roller 54 to be nipped and then brought into tight contact with the peripheral surface of the image recording drum 300.

Four inkjet heads 56C, 56M, 56Y, and 56K are arranged at certain intervals along the conveying path of the paper sheet P relating to the image recording drum 300.

Each of the inkjet heads 56C, 56M, 56Y, and 56K is formed of a line head, and formed to have a length corresponding to the maximum paper width. Each of the inkjet heads 56C, 56M, 56Y, and 56K is arranged such that a nozzle face (face where nozzles are arrayed) faces the peripheral surface of the image recording drum 300. Each of inkjet heads 56C, 56M, 56Y, and 56K ejects liquid droplets of ink from a nozzle formed at the nozzle face toward the image recording drum 300 to record an image on the paper sheet P being conveyed by the image recording drum 300.

Note that the inkjet recording device 10 in this embodiment uses the ultraviolet-curable aqueous ink as an ink, as described above.

The inline sensor 58 is arranged on the downstream side of the tail end inkjet head 56K with respect to the conveying direction of the paper sheet P by the image recording drum 300 to read out the image recorded by the inkjet heads 56C, 56M, 56Y, and 56K. The inline sensor 58, which is formed of a line scanner, for example, reads out the image recorded by the inkjet heads 56C, 56M, 56Y, and 56K from the paper sheet P being conveyed by the image recording drum 300.

Note that a contact prevention plate 59 is arranged on the downstream side of the inline sensor 58 in the vicinity of the inline sensor 58. The contact prevention plate 59 prevents the paper sheet P from being brought into contact with the inline sensor 58 in a case of coming-off of the paper sheet P due to conveyance failure or the like.

The mist filter 60 is arranged between the tail end inkjet head 56K and the inline sensor 58 to suck an air around the image recording drum 300 for catching the ink mist. In this way, sucking the air around the image recording drum 300 for catching the ink mist can prevent the ink mist from entering the inline sensor 58 and can prevent read-out failure or the like from occurring.

The drum cooling unit 62 blows a cold air to the image recording drum 300 to cool the image recording drum 300. The drum cooling unit 62 is configured to mainly include an air-conditioner (not shown), and a duct 62A for blowing a cool air supplied from the air-conditioner to the peripheral surface of the image recording drum 300. The duct 62A blows the cool air to the area of the image recording drum 300 except for an area through which the paper sheet P is conveyed to cool the image recording drum 300. The configuration in this example is such that since the paper sheet P is conveyed along a surface of an arc of an approximately upper half of the image recording drum 300, the duct 62A blows the cool air to an area of an approximately lower half of the image recording drum 300 to cool the image recording drum 300. Specifically, a blowing-out opening of the duct 62A is formed into an arc-shape so as to cover an approximately lower half of the image recording drum 300 to be configured such that the cool air is blown to the area of an approximately lower half of the image recording drum 300.

Here, a temperature for cooling the image recording drum 300 is set in relation to a temperature of the inkjet heads 56C, 56M, 56Y, and 56K (particularly, temperature of the nozzle face), and the image recording drum is cooled to have a temperature lower than that of inkjet heads 56C, 56M, 56Y, and 56K. This can prevent dew condensation from occurring on the inkjet heads 56C, 56M, 56Y, and 56K. In other words, setting the temperature of the image recording drum 300 to be lower than that of the inkjet heads 56C, 56M, 56Y, and 56K can induce the dew condensation on the image recording drum side and can prevent the dew condensation from occurring on the inkjet heads 56C, 56M, 56Y, and 56K (particularly, dew condensation occurring on the nozzle face).

The image recording unit 18 is configured as described above. The paper sheet P passed from the treatment liquid drying treatment drum 46 in the treatment liquid drying treatment unit 16 is received by the image recording drum 300. The image recording drum 300 rotates with gripping the leading end of the paper sheet P by the gripper to convey the paper sheet P. The paper sheet P passed to the image recording drum 300 firstly passes through the paper pressing roller 54 to be brought into tight contact with the peripheral surface of the image recording drum 300. At the same time as this, the paper sheet P is sucked from the suction apertures of the image recording drum 300 to be held by suction on the outer peripheral surface of the image recording drum 300. The paper sheet P is conveyed in this state while passing through each of the inkjet heads 56C, 56M, 56Y, and 56K. Then, in passing through the inkjet heads, the surface of the paper sheet P undergoes deposition of the liquid droplets of ink each of colors C, M, Y, and K from each of the inkjet heads 56C, 56M, 56Y, and 56K, respectively to render a color image on the relevant surface. The ink aggregation layer formed on the surface of the paper sheet P allows an image of high quality to be recorded without occurring feathering, bleeding and the like.

The paper sheet P having the image recorded thereon by the inkjet heads 56C, 56M, 56Y, and 56K is next to pass through the inline sensor 58. In passing through the inline sensor 58, the image recorded on the surface is read out. This reading out of the recorded image is carried out as needed such that the read out image is checked for deposition failure and the like. In carrying out of the reading out, the reading out is carried out in a state of being held by the image recording drum 300 by suction, allowing highly accurate reading out. Additionally, since the reading out is carried out immediately after recording the image, abnormity such as the deposition failure and the like can be immediately detected, for example, a measure against which can be rapidly taken. This can prevent recording in vain and can minimize occurrence of waste sheets.

After that, the paper sheet P is released from the suction, and thereafter, is passed to the ink drying treatment unit 20.

<Ink Drying Treatment Unit>

The ink drying treatment unit 20 subjects the paper sheet P after image recording to the drying treatment to remove liquid components remained on the surface of the paper sheet P. The ink drying treatment unit 20 is configured to include a chain gripper 64 for conveying the paper sheet P having the image recorded thereon, a back tension giving mechanism 66 for giving a back tension to the paper sheet P being conveyed by the chain gripper 64, an ink drying treatment unit 68 for subjecting the paper sheet P being conveyed by the chain gripper 64 to the drying treatment.

The chain gripper 64, which is a paper conveying mechanism used in common by the ink drying treatment unit 20, the ultraviolet irradiation unit 22, and the paper discharge unit 24, receives the paper sheet P passed from the image recording unit 18 to convey to the paper discharge unit 24.

The chain gripper 64 mainly includes a first sprocket 64A arranged in the vicinity of the image recording drum 300, a second sprocket 64B arranged in the paper discharge unit 24, a chain 64C, with no ends, wound around across the first sprocket 64A and the second sprocket 64B, a plurality of chain guides (not shown) for guiding run of the chain 64C, and a plurality of grippers 64D attached to the chain 64C at certain intervals. The first sprockets 64A, the second sprockets 64B, the chains 64C, and the chain guides are respectively formed into a pair to be arranged on both ends in the width direction of the paper sheet P. Each gripper 64D is arranged to be put across the chains 64C provided in a pair.

The first sprocket 64A is arranged in the vicinity of the image recording drum 300 such that the paper sheet P passed from the image recording drum 300 is received by the gripper 64D. The first sprocket 64A is rotatably arranged by being journaled by a bearing (not shown) and is connected with a motor (not shown). The chain 64C wound around across the first sprocket 64A and the second sprocket 64B runs by driving this motor.

The second sprocket 64B is arranged in the paper discharge unit 24 such that the paper sheet P received from the image recording drum 300 is collected in the paper discharge unit 24. In other words, the arrangement position of the second sprocket 64B is a terminal of the conveying path of the paper sheet P relating to the chain gripper 64. The second sprocket 64B is rotatably arranged by being journaled by the bearing (not shown).

The chain 64C is formed to have no ends and wound around across the first sprocket 64A and the second sprocket 64B.

The chain guides are arranged at predetermined positions to guide such that the chain 64C runs a predetermined course (=guides such that the paper sheet P is conveyed while running a predetermined conveying path). In the inkjet recording device 10 in this example, the second sprocket 64B is arranged at a position higher than the first sprocket 64A. This forms a running course in which the chain 64C becomes inclined in an intermediate portion. Specifically, the chain 64C includes a first horizontal conveying path 70A, an inclined conveying path 70B, and a second horizontal conveying path 70C.

The first horizontal conveying path 70A is set to be at the same height as the first sprocket 64A to set such that chain 64C wound across the first sprocket 64A horizontally runs.

The second horizontal conveying path 70C is set to be at the same height as the second sprocket 64B to set such that the chain 64C wound across the second sprocket 64B horizontally runs.

The inclined conveying path 70B is set between the first horizontal conveying path 70A and the second horizontal conveying path 70C to set so as to link between the first horizontal conveying path 70A and the second horizontal conveying path 70C.

The chain guides are arranged to form the first horizontal conveying path 70A, the inclined conveying path 70B, and the second horizontal conveying path 70C. Specifically, the chain guides are arranged at least at a joining point between the first horizontal conveying path 70A and the inclined conveying path 70B and at a joining point between the inclined conveying path 70B and the second horizontal conveying path 70C.

The plurality of grippers 64D are attached to the chain 64C at certain intervals. The attachment interval for the gripper 64D is set corresponding to a reception interval at which the paper sheet P is received from the image recording drum 300. In other words, the attachment interval is set to correspond to the reception interval of the paper sheet P from the image recording drum 300 such that the paper sheet P sequentially passed from the image recording drum 300 can be received from the image recording drum 300 at a timing of the paper sheet being passed.

The chain gripper 64 is configured as described above. As described above, when the motor (not shown) connected to the first sprocket 64A is driven, the chain 64C runs. The chain 64C runs at the same speed as the circumferential speed of the image recording drum 300. The timing is adjusted such that the paper sheet P passed from the image recording drum 300 can be received by each gripper 64D.

The back tension giving mechanism 66 gives back tension to the paper sheet P which is conveyed while the leading end being gripped by the chain gripper 64. The back tension giving mechanism 66 mainly includes a guide plate 72 and a sucking mechanism (not shown) for sucking an air from suction apertures (not shown) formed on the guide plate 72.

The guide plate 72 includes a hollow box plate having a width corresponding to the paper width. The guide plate 72 is arranged along the conveying path of the paper sheet P relating to the chain gripper 64 (=running course of the chain). Specifically, the guide plate 72 is arranged along the chain 64C running the first horizontal conveying path 70A and the inclined conveying path 70B, and arranged to be separated from the chain 64C by a predetermined distance. The paper sheet P being conveyed by the chain gripper 64 is conveyed with a back surface thereof (surface having no image recorded thereon) being slidably in contact with on a top surface of the guide plate 72 (surface facing the chain 64C: slidable contact surface).

The slidable contact surface (top surface) of the guide plate 72 has plenty of suction apertures formed (not shown in FIG. 1). As described above, the guide plate 72 is formed of the hollow box plate. The sucking mechanism (not shown) sucks a hollow portion (inside) of the guide plate 72. This allows the air to be sucked from the suction apertures formed on the slidable contact surface.

Sucking the air from the suction apertures of the guide plate 72 causes the back surface of the paper sheet P being conveyed by the chain gripper 64 to be sucked to the suction aperture. This gives the back tension to the paper sheet P being conveyed by the chain gripper 64.

As described above, since the guide plate 72 is arranged along the chain 64C running the first horizontal conveying path 70A and the inclined conveying path 70B, the paper sheet P is given the back tension while being conveyed on the first horizontal conveying path 70A and the inclined conveying path 70B.

The ink drying treatment unit 68 is arranged inside the chain gripper 64 (particularly, a portion constituting first horizontal conveying path 70A) to subject the paper sheet P being conveyed on the first horizontal conveying path 70A to the drying treatment. The ink drying treatment unit 68 blows a hot air to the surface of the paper sheet P being conveyed on the first horizontal conveying path 70A to be subjected to the drying treatment. A plurality of ink drying treatment units 68 are arranged along the first horizontal conveying path 70A. The number of the ink drying treatment units 68 arranged is set depending on a capacity of the ink drying treatment unit 68, a conveying speed of the paper sheet P (=printing speed) or the like. In other words, the number is set such that the paper sheet P received from the image recording unit 18 can be dried while being conveyed on the first horizontal conveying path 70A. Therefore, a length of the first horizontal conveying path 70A is also set in consideration of capacity of the ink drying treatment unit 68.

Note that the drying treatment causes a humidity of the ink drying treatment unit 20 to be risen. Since rising of the humidity makes the efficient drying treatment difficult, it is preferable that the ink drying treatment unit 20 is provided with exhaust means together with the ink drying treatment unit 68 to forcibly exhaust humid air generated due to the drying treatment. The exhaust means may have a configuration in which, for example, an exhaust duct is arranged at the ink drying treatment unit 20 to exhaust the air in the ink drying treatment unit 20 by the exhaust duct.

The ink drying treatment unit 20 is configured as described above. The paper sheet P passed from the image recording drum 300 in the image recording unit 18 is received by the chain gripper 64. The chain gripper 64 conveys the paper sheet P along the planar guide plate 72 with gripping the leading end of the paper sheet P by the gripper 64D. The paper sheet P passed to the chain gripper 64 is firstly conveyed on the first horizontal conveying path 70A. In the course of being conveyed on the first horizontal conveying path 70A, the paper sheet P is subjected to the drying treatment by the ink drying treatment unit 68 arranged inside the chain gripper 64. In other words, the hot air is blown to the surface (image record surface) to be subjected to the drying treatment. At this time, the paper sheet P is given the back tension by the back tension giving mechanism 66 while being subjected to the drying treatment. By doing so, the paper sheet P can be prevented from being deformed while being subjected to the drying treatment.

<Ultraviolet Irradiation Unit>

The ultraviolet irradiation unit 22 irradiates the image recorded by use of the ultraviolet-curable aqueous ink with ultraviolet (UV) rays to fix the image. The ultraviolet irradiation unit 22 mainly includes the chain gripper 64 for conveying the paper sheet P subjected to the drying treatment, the back tension giving mechanism 66 for giving the back tension to the paper sheet P being conveyed by the chain gripper 64, an ultraviolet irradiation unit 74 for irradiating the paper sheet P being conveyed by the chain gripper 64 with the ultraviolet rays.

As described above, the chain gripper 64 and the back tension giving mechanism 66 are used together in common by the ink drying treatment unit 20 and the paper discharge unit 24.

The ultraviolet irradiation unit 74 is arranged inside the chain gripper 64 (particularly, a portion constituting the inclined conveying path 70B) to irradiate with the ultraviolet rays the surface of the paper sheet P being conveyed on the inclined conveying path 70B. A plurality of ultraviolet irradiation units 74, each including the ultraviolet rays lamp (UV lamp), are arranged along the inclined conveying path 70B. Then, the ultraviolet irradiation units 74 irradiate the ultraviolet rays toward the surface of the paper sheet P being conveyed on the inclined conveying path 70B. The arranged number of the ultraviolet irradiation unit 74 is set depending on the conveying speed of the paper sheet P (=printing speed) or the like. In other words, the configuration is such that the image can be fixed by the ultraviolet rays irradiated while the paper sheet P is conveyed on the inclined conveying path 70B. Therefore, a length of the inclined conveying path 70B is also set in consideration of the conveying speed of the paper sheet P or the like.

The ultraviolet irradiation unit 22 is configured as described above. The paper sheet P conveyed by the chain gripper 64 to be subjected to the drying treatment by the ink drying treatment unit 20 is next conveyed on the inclined conveying path 70B. In the course of being conveyed on the inclined conveying path 70B, the paper sheet P is irradiated with the ultraviolet rays by the ultraviolet irradiation unit 74 arranged inside the chain gripper 64. In other words, the ultraviolet rays are irradiated from the ultraviolet irradiation unit 74 toward the surface. At this time, the paper sheet P is given the back tension by the back tension giving mechanism 66 while being subjected to ultraviolet ray irradiation. By doing so, the paper sheet P can be prevented from being deformed while being subjected to the ultraviolet ray irradiation. Since the ultraviolet irradiation unit 22 is arranged on the inclined conveying path 70B and the inclined conveying path 70B is provided with the inclined guide plate 72, even if the paper sheet P falls off the gripper 64D in the middle of conveyance, the paper sheet can be slid on the guide plate 72 to be taken out.

<Paper Discharge Unit>

The paper discharge unit 24 discharges and collects the paper sheet P having been subjected to a series of image recording process. The paper discharge unit 24 is configured to mainly include the chain gripper 64 for conveying the paper sheet P irradiated with the ultraviolet rays, and a paper discharge platform 76 collecting the paper sheet P to be stacked thereon.

As described above, the chain gripper 64 is used together in common by the ink drying treatment unit 20 and the ultraviolet irradiation unit 22. The chain gripper 64 releases the paper sheet P on the paper discharge platform 76 to stack the paper sheet P on the paper discharge platform 76.

The paper discharge platform 76 collects the paper sheet P released by the chain gripper 64 to be stacked thereon. The paper discharge platform 76 is provided with paper stops (front paper stop, rear paper stop, side paper stop or the like) (not shown) so as to neatly stack the paper sheet P.

The paper discharge platform 76 is provided so as to be capable of being lifted and lowered by a paper discharge platform lifting and lowering device (not shown). The paper discharge platform lifting and lowering device is controlled to be driven in conjunction with increase and decrease of the paper sheets P stacked on the paper discharge platform 76 to lift and lower the paper discharge platform 76 such that the paper sheet P placed on the top is always is positioned at a certain height.

<<Control System>>

Figure 2:
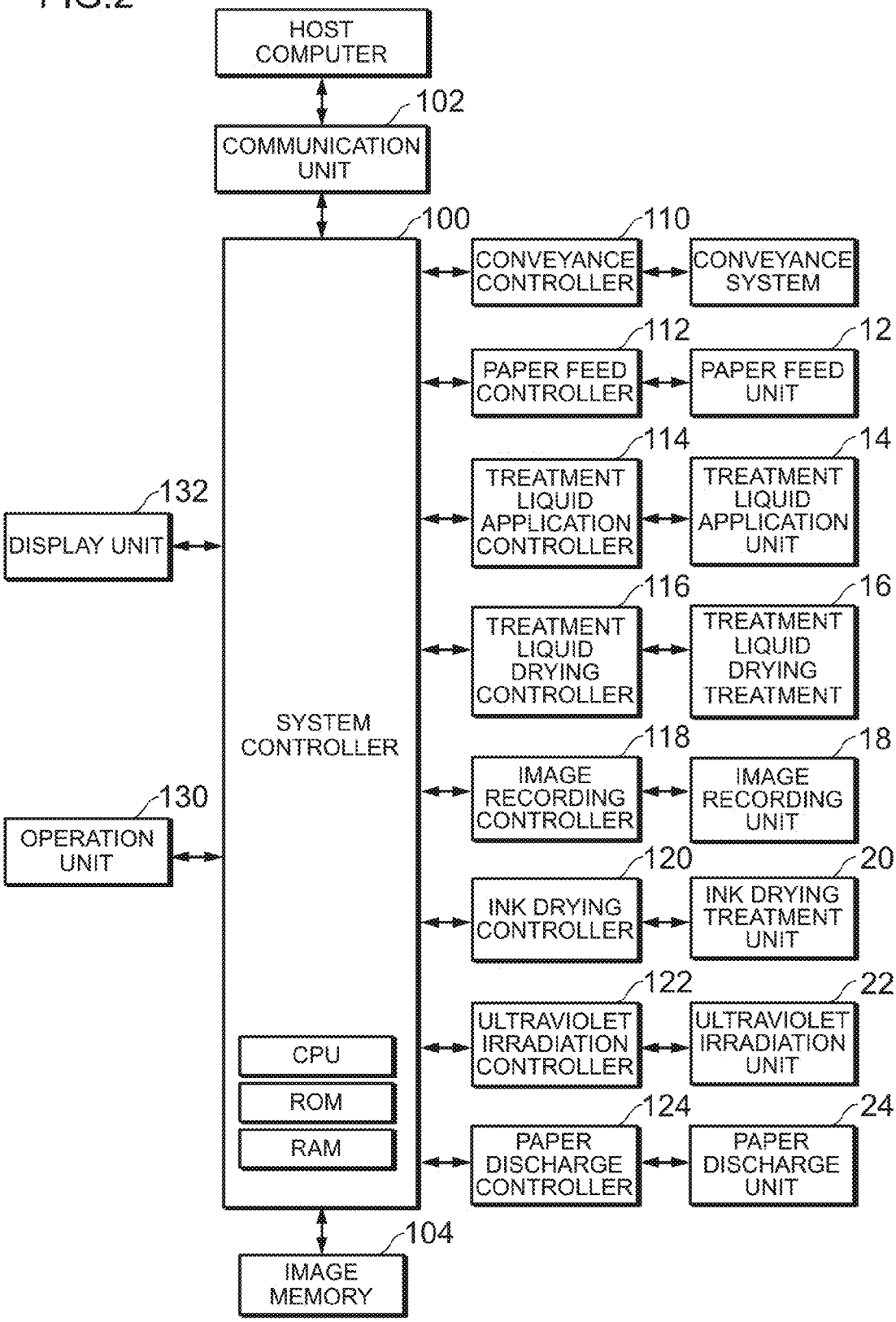
FIG. 2 is a block diagram illustrating a schematic configuration of a control system of the inkjet recording device.

FIG. 2 is a block diagram illustrating a schematic configuration of a control system of the inkjet recording device in this embodiment.

As shown in the relevant figure, the inkjet recording device 10 includes a system controller 100, a communication unit 102, an image memory 104, a conveyance controller 110, a paper feed controller 112, a treatment liquid application controller 114, a treatment liquid drying controller 116, an image recording controller 118, an ink drying controller 120, an ultraviolet irradiation controller 122, a paper discharge controller 124, an operation unit 130, and a display unit 132.

The system controller 100 functions as control means generally controlling each component of the inkjet recording device 10 and functions as arithmetic means performing various arithmetic processing. The system controller 100 includes a CPU, a ROM, a RAM and the like to operate in accordance with a predetermined control program. In the ROM, a control program executed by the system controller 100 and various data needed for controlling are stored.

The communication unit 102 includes a necessary communication interface to send and receive the data to and from a host computer connected via the communication interface.

The image memory 104 functions as transient storage means of various data including the image data, where the data is read and written via the system controller 100. The image data taken via the communication unit 102 from the host computer is stored in the image memory 104.

The conveyance controller 110 controls a conveyance system for the paper sheet P in the inkjet recording device 10. In other words, the controller 110 controls driving of the tape feeder 36A, the front stop 38 and the paper feed drum 40 in the paper feed unit 12 as well as controls driving of the treatment liquid deposition drum 42 in the treatment liquid application unit 14, the treatment liquid drying treatment drum 46 in the treatment liquid drying treatment unit 16, and the image recording drum 300 in the image recording unit 18. The controller 110 also controls driving of the chain gripper 64 and the back tension giving mechanism 66 which are used in common by the ink drying treatment unit 20, the ultraviolet irradiation unit 22 and the paper discharge unit 24.

The conveyance controller 110 controls the conveyance system in response to an instruction from the system controller 100 such that the paper sheet P is controlled to be uneventfully conveyed from the paper feed unit 12 to the paper discharge unit 24.

The paper feed controller 112 controls the paper feed unit 12 in response to an instruction from the system controller 100. Specifically, the controller 112 controls driving of the sucker (sucking device) 32, a paper feed platform lifting and lowering mechanism and the like such that the paper sheet P stacked on the paper feed platform 30 is controlled to be sequentially fed one by one without stacking one on top of another.

The treatment liquid application controller 114 controls the treatment liquid application unit 14 in response to an instruction from the system controller 100. Specifically, the controller 114 controls driving of the treatment liquid deposition unit 44 such that the paper sheet P being conveyed by the treatment liquid deposition drum 42 is applied with the treatment liquid.

The treatment liquid drying controller 116 controls the treatment liquid drying treatment unit 16 in response to an instruction from the system controller 100. Specifically, the controller 116 controls driving of the treatment liquid drying treatment unit 50 such that the paper sheet P being conveyed by the treatment liquid drying treatment drum 46 is subjected to the drying treatment.

The image recording controller 118 controls the image recording unit 18 in response to an instruction from the system controller 100. Specifically, the controller 118 controls driving of the inkjet heads 56C, 56M, 56Y, and 56K such that a predetermined image is recorded on the paper sheet P being conveyed by the image recording drum 300. Additionally, the controller 118 controls operation of the inline sensor 58 such that the recorded image is read out.

The ink drying controller 120 controls the ink drying treatment unit 20 in response to an instruction from the system controller 100. Specifically, the controller 120 controls driving of the ink drying treatment unit 68 such that the hot air is blown to the paper sheet P being conveyed by the chain gripper 64.

The ultraviolet irradiation controller 122 controls the ultraviolet irradiation unit 22 in response to an instruction from the system controller 100. Specifically, the controller 122 controls driving of the ultraviolet irradiation unit 74 such that the paper sheet P being conveyed by the chain gripper 64 is irradiated with the ultraviolet rays.

The paper discharge controller 124 controls the paper discharge unit 24 in response to an instruction from the system controller 100. Specifically, the controller 124 controls driving of the paper discharge platform lifting and lowering mechanism and the like such that the paper sheet P is stacked on the paper discharge platform 76.

The operation unit 130 includes necessary operation means (e.g., an operation button, a keyboard, a touch panel or the like) to output operation information input from the operation means to the system controller 100. The system controller 100 performs various processes in response to the operation information input from the operation unit 130.

The display unit 132 includes a necessary display device (e.g., an LCD panel or the like) to display necessary information in response to an instruction from the system controller 100.

As described above, the image data to be recorded on the paper sheet is taken in the inkjet recording device 10 from the host computer via the communication unit 102. The taken image data is stored in the image memory 104.

The system controller 100 performs necessary signal processing on the image data stored in the image memory 104 to generate dot data. The controller 100 controls, according to the generated dot data, driving of each of the inkjet heads 56C, 56M, 56Y, and 56K in the image recording unit 18 to record an image expressed by the image data on the paper sheet.

The dot data is generally generated by performing color conversion processing and halftone processing on image data. The color conversion processing is for example processing in which the image data expressed by sRGB (for example RGB 8-bit image data) or the like is converted into ink amount data for each ink color used in the inkjet recording device 10 (in the example, converted into ink amount data for each color of C, M, Y, and K). The Halftone processing is processing in which processing of error diffusion or the like is performed on the ink amount data of each color generated by the color conversion processing, thereby converting the ink amount data into dot data for each color.

The system controller 100 performs color conversion processing and halftone processing on the image data to generate the dot data for each color. Based on the generated dot data for each color, the system controller 100 then controls driving of the corresponding inkjet heads to record an image expressed by the image data on the paper sheet.

<<Recording Operation by Inkjet Recording Device>>

Next, a description is given of an image recording operation by the inkjet recording device 10 configured as described above in this embodiment.

When the system controller 100 is instructed via the operation unit 130 to start a print job, a period-up process is performed. In other words, each unit performs a preparation operation such that a stable operation can be performed.

When the period-up process is completed, a print process is started. In other words, the paper sheet P is sequentially fed from the paper feed unit 12.

The paper feed unit 12 feeds the paper sheets P stacked on the paper feed platform 30 by the sucker (sucking device) 32 sequentially from the top one by one. The paper sheet P fed by the sucker (sucking device) 32 is placed on the feeder board 36 one by one via the paper feed roller pair 34.

The paper sheet P placed on the feeder board 36 is given a feed by the tape feeder 36A included in the feeder board 36 so as to be slid on the feeder board 36 and conveyed to the paper feed drum 40. At this time, the paper sheet P sequentially fed is slid on the feeder board 36 to be conveyed to the paper feed drum 40 one by one without stacking one on top of another. In this conveying course, the top surface of the paper sheet is pressed toward the feeder board 36 by the retainer 36B. This corrects irregularity.

The paper sheet P conveyed to the terminal of the feeder board 36 abuts on the front stop 38 at the leading end thereof, and thereafter, is passed to the paper feed drum 40. This allows the paper sheet P in a certain attitude without occurrence of inclination to be fed to paper feed drum 40.

The paper feed drum 40, while rotating, grips the leading end of the paper sheet P by the gripper 40A to receive the paper sheet P and conveys the paper sheet P toward the treatment liquid application unit 14.

The paper sheet P conveyed to the treatment liquid application unit 14 is passed from the paper feed drum 40 to the treatment liquid deposition drum 42.

The treatment liquid deposition drum 42, while rotating, grips the leading end of the paper sheet P by the gripper 40A to receive the paper sheet and conveys the paper sheet P toward the treatment liquid drying treatment unit 16. The paper sheet P, in the course of being conveyed by the treatment liquid deposition drum 42, is pressed and abutted against the application roller 44A on the surface thereof to be applied (coated) with the treatment liquid on the surface thereof.

The paper sheet P applied with the treatment liquid on the surface thereof is passed from the treatment liquid deposition drum 42 to the treatment liquid drying treatment drum 46.

The treatment liquid drying treatment drum 46, while rotating, grips the leading end of the paper sheet P to receive the paper sheet and conveys the paper sheet P toward the image recording unit 18. The paper sheet P, in the course of being conveyed by the treatment liquid drying treatment drum 46, is subjected to the drying treatment in which the surface thereof receives the hot air blown from the treatment liquid drying treatment unit 50. This removes solvent components in the treatment liquid and forms an ink aggregation layer on the surface of the paper sheet P (image record surface).

The paper sheet P subjected to the drying treatment with the treatment liquid is passed from the treatment liquid drying treatment drum 46 to the image recording drum 300.

The image recording drum 300, while rotating, grips the leading end of the paper sheet P to receive the paper sheet and conveys the paper sheet P toward the ink drying treatment unit 20. The paper sheet P, in the course of being conveyed by the image recording drum 300, undergoes on the surface thereof deposition of the liquid droplets of ink each of colors C, M, Y, and K by each of the inkjet heads 56C, 56M, 56Y, and 56K, respectively to record an image. The image recorded in the conveying course is read out by the inline sensor 58. At this time, the paper sheet P is held by suction on the peripheral surface of the image recording drum 300 while being conveyed. Then, in a state of being held by suction, image recording and reading out of the recorded image are carried out. This allows the image to be highly accurately recorded and the image to be highly accurately read out.

The paper sheet P having the image recorded thereon is passed from the image recording drum 300 to the chain gripper 64.

The chain gripper 64 grips the leading end of the paper sheet P by the grippers 64D attached to the chain 64C running to receive the paper sheet P and conveys the paper sheet toward the paper discharge unit 24.

The paper sheet P, in the conveying course by the chain gripper 64, firstly is subjected to an ink drying treatment. In other words, the hot air is blown to the surface from the ink drying treatment unit 68 arranged on the first horizontal conveying path 70A. By doing so, the drying treatment is carried out. At this time, the paper sheet P is conveyed with the back surface thereof being held by the guide plate 72 by suction to be given the back tension. By doing so, the paper sheet P can be prevented from being deformed while being subjected to the drying treatment.

The paper sheet P after completion of the drying treatment (paper sheet P having passed through the ink drying treatment unit 20) is subsequently irradiated with the ultraviolet rays. In other words, the ultraviolet rays is emitted to the surface from the ultraviolet irradiation unit 74 arranged on the inclined conveying path 70B. This cures the ink included in the image to fix the image on the paper sheet P. At this time, the paper sheet P is conveyed with the back surface thereof being held by the guide plate 72 by suction to be given the back tension. By doing so, the paper sheet P can be prevented from being deformed while being subjected to a treatment for fixing The paper sheet P after completion of the ultraviolet ray irradiation (paper sheet P having passed through the ultraviolet irradiation unit 22) is conveyed toward the paper discharge unit 24, and released at the paper discharge unit 24 from the grippers 64D to be stacked on the paper discharge platform 76.

As described above, the image recording process is completed by a series of operations. As described above, since paper sheet P is successively fed from the paper feed unit 12, each unit successively deals with the successively fed paper sheet P to perform the image recording process.

As described above, according to the inkjet recording device 10 in this embodiment, the paper sheet P having the image recorded thereon is received from the image recording unit 18 by the chain gripper 64, and in the conveying course by the chain gripper 64 is subjected to the ink drying treatment and the ultraviolet ray irradiation. The chain gripper 64 has a degree of freedom for setting the conveying path of the paper sheet such that the ink drying treatment unit 68 and the ultraviolet irradiation unit 74 can be arranged in a high density. This allows the paper sheet P on which the image has been recorded to be subjected to the drying treatment efficiently in a short time, drying the ink before permeating the paper sheet P. By doing so, the paper sheet P can be prevented from being deformed. Similarly, the treatment in emitting the ultraviolet rays can be also efficiently carried out.

The drying treatment and the ultraviolet ray irradiation are carried out by conveying means (chain gripper 64 in this example) other than conveying means for image recording (image recording drum 300 in this example), suppressing temperature rise of the conveying means for image recording which is caused by heat generated in the drying treatment and in the ultraviolet ray irradiation. This can effectually prevent dew condensation from occurring on the inkjet heads and the nozzle drying from being promoted.

Since the inkjet recording device 10 in this embodiment is configured to give the back tension to the paper sheet P in carrying out the drying treatment and the ultraviolet ray irradiation, the drying treatment and the ultraviolet ray irradiation can be carried out with the paper sheet P being prevented from being deformed.

Further, the inkjet recording device 10 in this embodiment is configured to arrange the inline sensor 58 in the image recording unit 18 to read out the recorded image immediately after recording the image, rapidly performing detection of the deposition failure or the like on the basis of a result of image recording. This can rapidly take a measure against the case where the deposition failure or the like is detected and can effectively suppress occurrence of waste sheet.

Additionally, the device 10 is configured to read the image with the paper sheet being held by the image recording drum 300 (the same as the state in the image recording), highly accurately reading out the image. In other words, if the image is read out after the paper sheet P is removed from the image recording drum 300, a condition of the paper sheet possibly varies to make it difficult to highly accurately read out the image. However, by reading out the image with the paper sheet being held by the image recording drum 300, the image can be read out without varying the condition of the paper sheet P, highly accurately performing the reading out of the image. Particularly, the inkjet recording device 10 in this embodiment conveys the paper sheet P in a state of being held by suction on the peripheral surface of the image recording drum 300, highly accurately reading out the image.

<<Structure of Image Recording Drum as Medium-Holding Device and as Medium-Conveying Device>>

Next, a description is given of a configuration of the image recording drum 300 which functions as the medium-holding device and as the medium-conveying device.

<Configuration>

Figure 3:
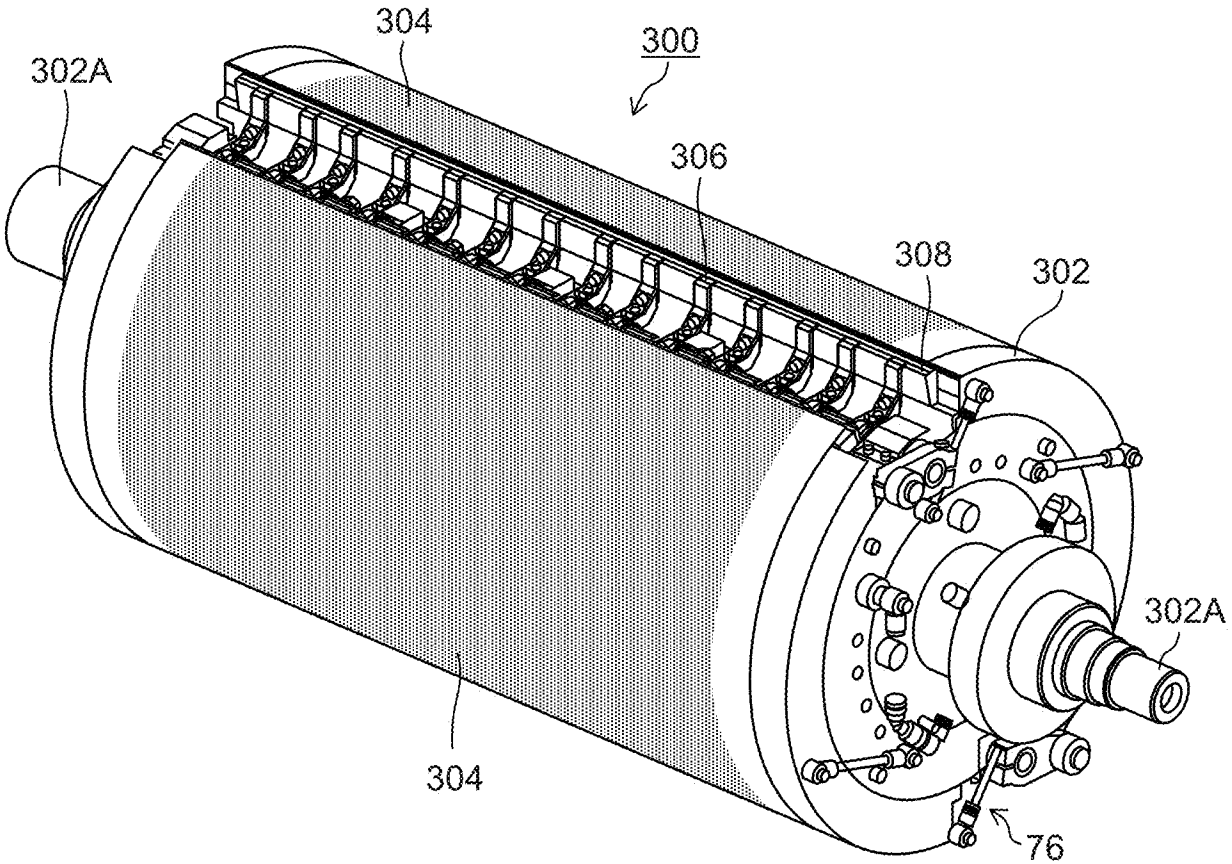
FIG. 3 is a perspective view illustrating an overall structure of an image recording drum.
Figure 4:
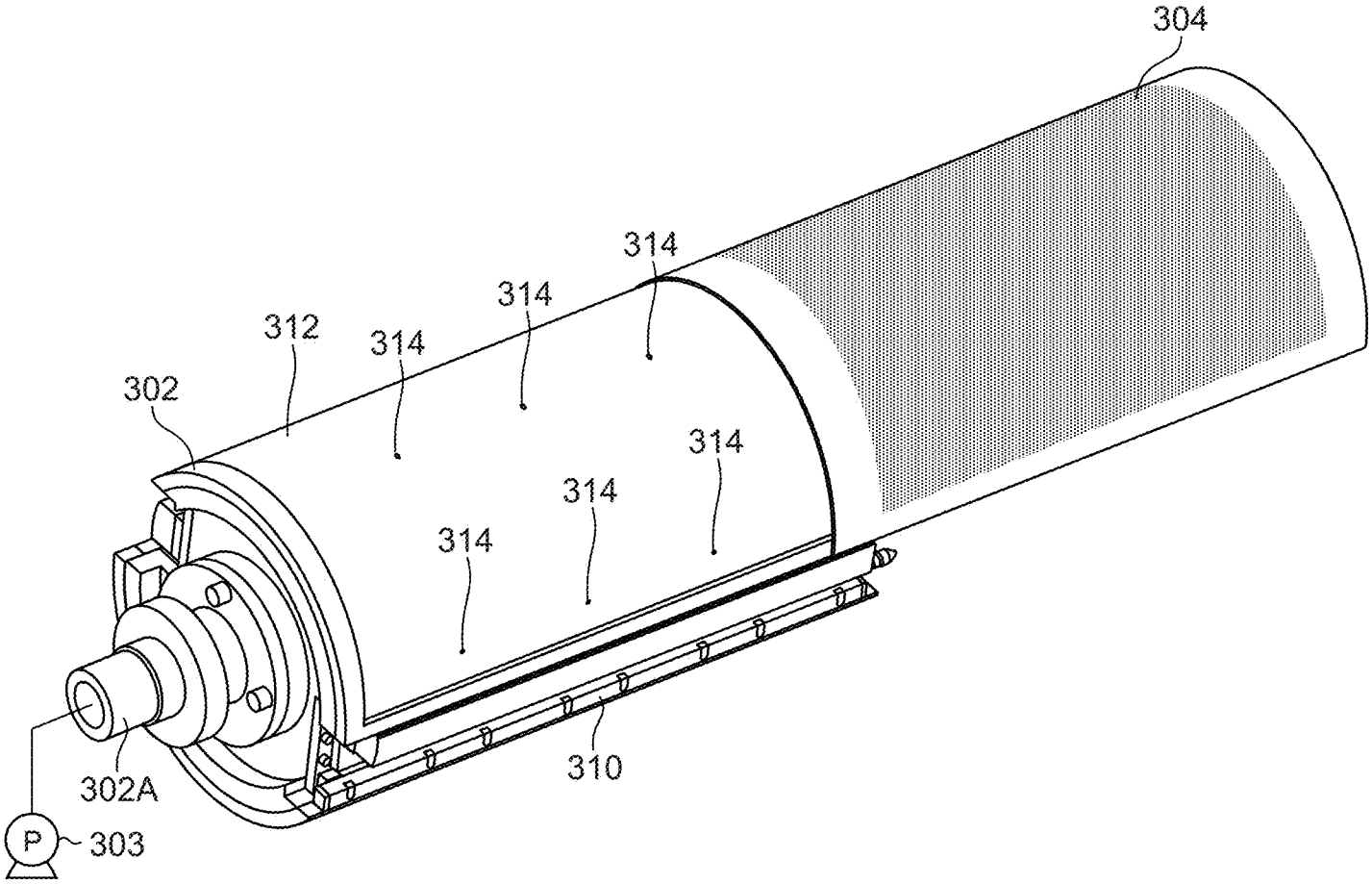
FIG. 4 is an exploded perspective view of the image recording drum shown in FIG. 3.

FIG. 3 is a perspective view illustrating an overall structure of the image recording drum. FIG. 4 is an exploded perspective view of the image recording drum shown in FIG. 3.

The image recording drum 300 in this embodiment, which grips the leading end of the paper sheet P and holds the paper sheet P by suction on the outer peripheral surface, rotates about an axis to convey the paper sheet P.

The image recording drum 300 in this embodiment is configured to mainly include a main body 302 formed into a drum shape, covers 304 attached to two areas on the peripheral surface of the main body 302, and grippers 306 arranged on the peripheral surface of the main body 302.

The main body 302 is formed into a drum shape. The main body 302 has a rotation shaft 302A centrally located therein. The image recording drum 300 is rotatably journaled with the rotation shaft 302A being borne by a bearing (not shown) included in a main body frame (not shown) of the inkjet recording device 10.

The rotation shaft 302A is coupled with a motor (not shown) via a rotation transmission mechanism not shown. The motor functions as rotary drive means of the image recording drum 300. The image recording drum 300 is driven by the motor to be rotated.

As described above, the cover 304 is attached to each of two areas on the peripheral surface of main body 302. The cover 304 which is formed into a sheet shape is attached to the peripheral surface of the main body 302 to configure the outer peripheral surface of the main body 302. In other words, the cover 304 configures a suction-holding surface of the paper sheet P.

Figure 5:
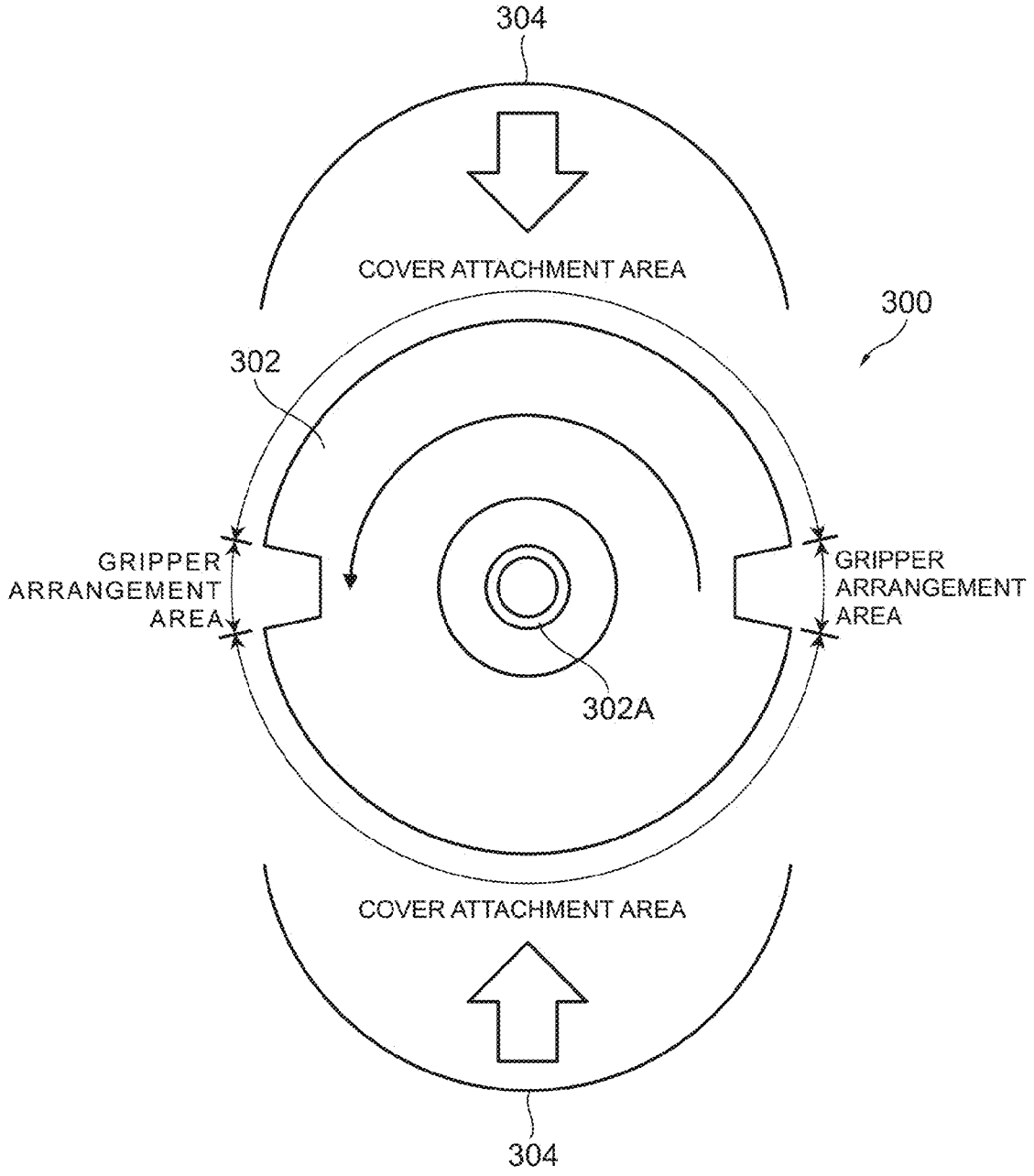
FIG. 5 is an exploded lateral view of a main body and covers of the image recording drum.

As shown in FIG. 5, a cover attachment area is formed at each of two areas in a circumferential direction on the peripheral surface of the main body 302. The cover attachment area of the main body 302 is covered by the cover 304.

Two cover attachment areas are set at certain intervals in the circumferential direction of the main body 302. A gripper arrangement area is set between two cover attachment areas. The gripper arrangement area which is formed to be recessed from the peripheral surface of the main body 302 is formed as a recessed portion. The gripper 306 is arranged at the gripper arrangement area.

As described above, the cover 304 is formed into a sheet shape. The cover 304 is detachably attached to the main body 302. The main body 302 includes cover fixing means for fixing the cover 304 to the main body 302.

The cover fixing means is configured to include a front end gripping member 308 for gripping an edge of a front end of the cover 304 and a rear end gripping member 310 for gripping an edge of a rear end of the cover 304.

The front end gripping member 308 is arranged at a front end portion of the cover attachment area. The front end gripping member 308 includes an openable and closable gripping claw to pinch the edge along the front end of the cover 304 to be gripped.

The rear end gripping member 310 is arranged at a rear end portion of the cover attachment area. The rear end gripping member 310 includes an openable and closable gripping claw to pinch the edge along the read end of the cover 304 to be gripped.

The rear end gripping member 310 is arranged movably back and forth in the circumferential direction by use of a position adjustment mechanism (not shown) included in the main body 302. A position of the rear end gripping member 310 is adjusted by the position adjustment mechanism such that a position of the rear end gripping member 310 can be adjusted with respect to the front end gripping member 308. This can give a tension to the cover 304 gripped by the front end gripping member 308 and the rear end gripping member 310.

The cover 304 is gripped by the front end gripping member 308 at the edge of the front end thereof and gripped by the rear end gripping member 310 at the edge of the rear end thereof to be attached to the main body 302. The cover 304 attached to the main body 302 is given a tension by adjusting the position of rear end gripping member 310 by use of the position adjustment mechanism for the rear end gripping member 310 so as to be arranged in tight contact with the peripheral surface of the main body 302.

The cover attachment area has a sucking area set therein. The sucking area which is set as an area for sucking the air by way of the sucking mechanism is set correspondingly to a paper suction-holding area.

The paper suction-holding area is an area for holding the paper sheet P by suction on the suction-holding surface. The paper sheet P is held by suction within the paper suction-holding area.

The sucking area is set in a manner that one sucking area is for one paper suction-holding area. The sucking area is formed as a recessed portion having a predetermined depth on the peripheral surface of the main body 302 to function as a sucking part 312. The sucking part 312 is fully covered by the cover 304 when the cover 304 is attached to the main body 302.

Covering the sucking part 312 by the cover 304 is to form a sucking space S, on a back side (inner side) of the cover 304, which is defined by the cover 304 and the sucking part 312. This sucking space S is formed corresponding to the paper suction-holding area.

The sucking part 312 includes sucking holes 314 from which the air in the sucking space S is sucked. The main body 302 has a flow path (not shown) inside thereof in communication with the sucking hole 314. The flow path is in communication with a flow path for connection provided inside the rotation shaft 302A.

The flow path for connection is connected with a vacuum pump 303 via a pipe arrangement not shown (see FIG. 4, similarly in other figures). The vacuum pump 303 functions as sucking means. The sucking space S is sucked by driving the vacuum pump 303 (brought into a negative pressure).

The cover 304 covering the sucking part 312 has plenty of suction apertures 320 formed thereon. The suction aperture 320 is arranged inside the paper suction-holding area. The suction aperture 320 is formed to penetrate from the surface of the cover 304 to the back surface. Therefore, when the cover 304 is attached to the main body 302, each suction aperture 320 is brought into communication with the sucking space S.

Figure 6:
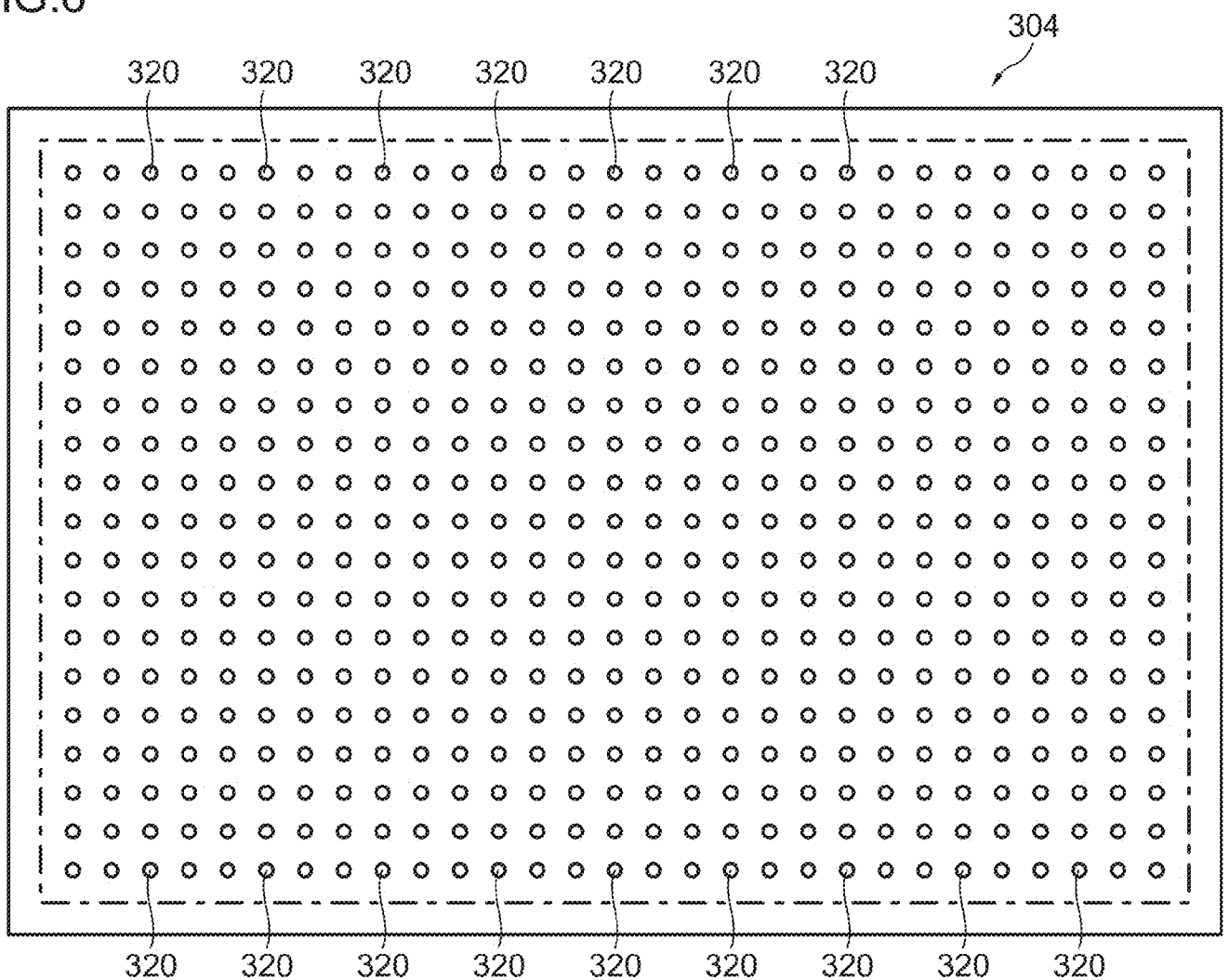
FIG. 6 is a development view of the cover on a front surface side thereof.

FIG. 6 is a development view of the cover on a front surface side thereof.

As shown in the relevant figure, assuming that the circumferential direction of the image recording drum 300 is a longitudinal direction and an axial direction (width direction) of the image recording drum 300 is a transverse direction, the suction apertures 320 are arrayed inside the paper suction-holding area at a certain pitch in the longitudinal and transverse directions. The respective suction apertures 320 all are formed to have the same diameter.

The respective suction apertures 320 all are formed to have the same diameter, but a specific suction aperture includes a narrowing member 322 having a portion in communication with the sucking space S made to be narrowed.

In the following description, a suction aperture including the narrowing member 322 (specific suction aperture) is referred to as a "narrowed suction aperture 320A", and a suction aperture not including the narrowing member 322 is referred to as "non-narrowed suction aperture 320B" for distinguishing one from the other.

Figure 7:
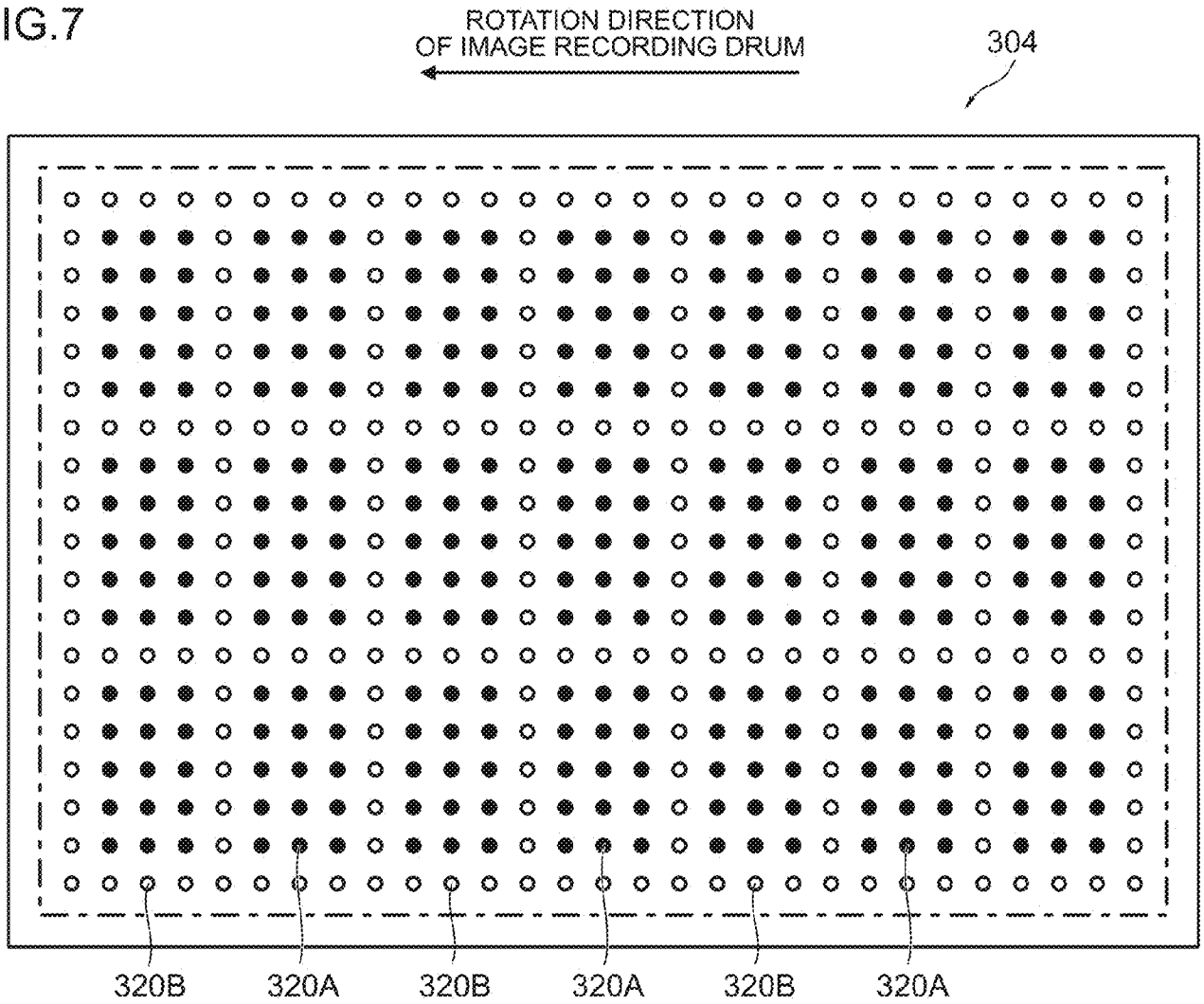
FIG. 7 is a view illustrating a distribution of narrowed suction apertures and non-narrowed suction apertures.

FIG. 7 is a view illustrating a distribution of the narrowed suction apertures and the non-narrowed suction apertures.

In the relevant figure, the narrowed suction aperture 320A is expressed by a black circle (●) and the non-narrowed suction aperture 320B is expressed by a while circle (○) for the sake of expediency.

As shown in the relevant figure, the image recording drum 300 in this embodiment has the non-narrowed suction apertures 320B arranged in a frame shape so as to be repeatedly arranged on the suction-holding surface with a certain period longitudinally and transversely.

Figure 8:
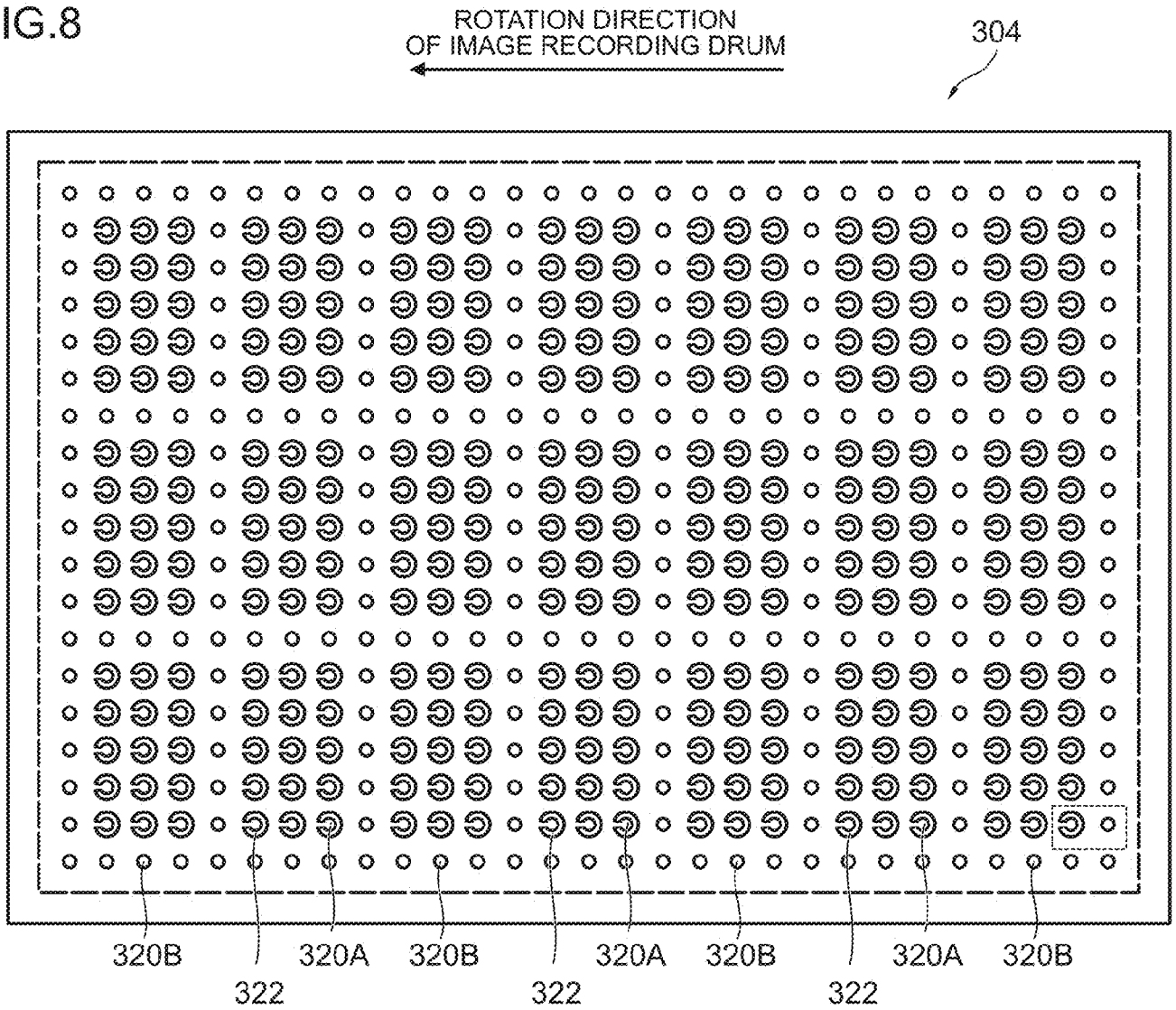
FIG. 8 is a development view of the cover on a back surface side thereof.

FIG. 8 is a development view of the cover on a back surface side thereof.

As shown in the relevant figure, the narrowed suction aperture 320A includes the narrowing member 322.

Figure 9:
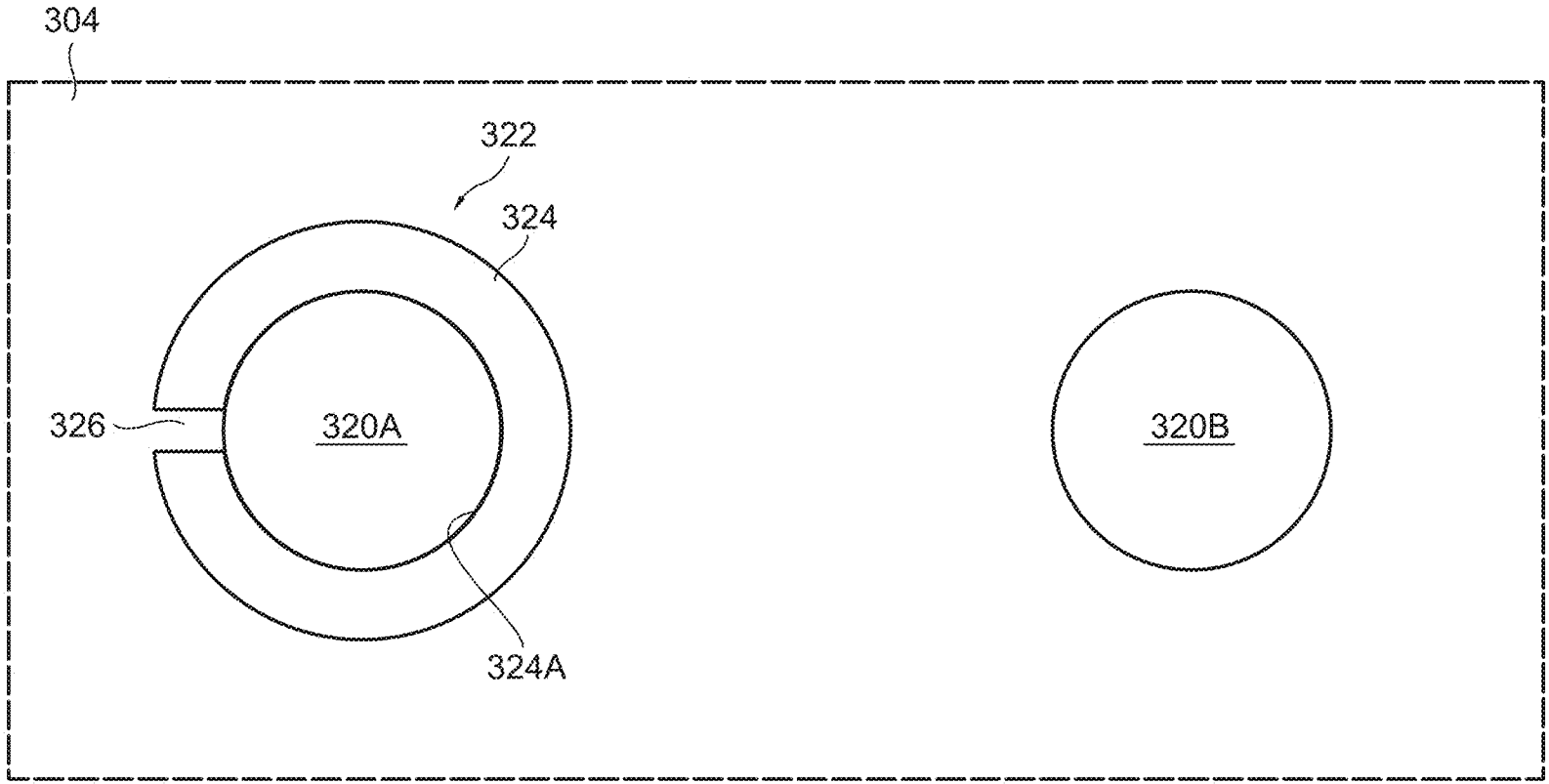
FIG. 9 is an enlarged view showing an enlarged part of the back surface of the cover.
Figure 10:
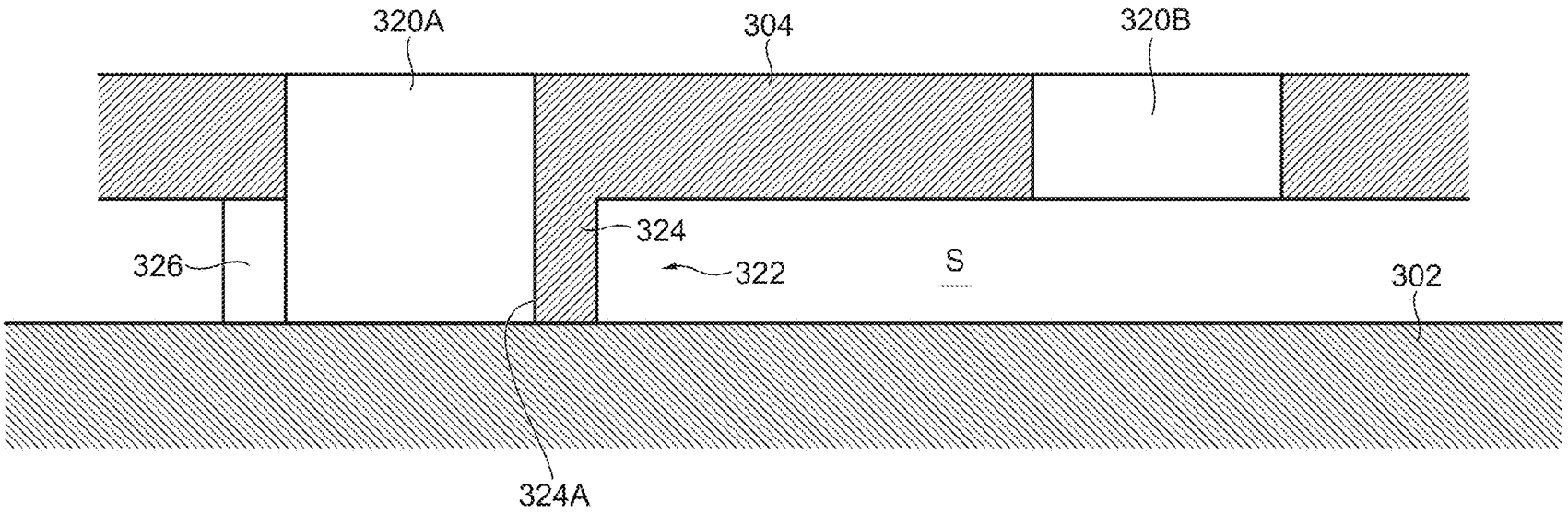
FIG. 10 is an enlarged view showing an enlarged cross-section of a part of the cover.

FIG. 9 is an enlarged view showing a part of the back surface of the cover enlarged. FIG. 10 is an enlarged view showing a part of a cross-section of the cover enlarged.

The narrowing member 322 includes a narrowing member main body 324 and a narrowing flow path 326 formed in the narrowing member main body 324.

In this embodiment, the narrowing member main body 324 is formed in a cylindrical shape and has an inner periphery formed as a communication hole 324A to be in communication with the narrowed suction aperture 320A. The communication hole 324A is formed to have a diameter the same as the narrowed suction aperture 320A and is arranged concentrically with the narrowed suction aperture 320A. In other words, the hole 324A is concentric and in communication with the narrowed suction aperture 320A.

An end face of the narrowing member main body 324 is made flat. The end face of the narrowing member main body 324 abuts on the main body 302 when the cover 304 is attached to the main body 302. In other words, the end face of the main body 324 abuts on a bottom face portion of the sucking part 312 formed as the recessed portion. Abutment of the end face of the narrowing member main body 324 on the main body 302 causes an opening portion of the communication hole 324A formed at the end face to be blocked by the main body 302.

The narrowing flow path 326 is formed by cutting out a part of a wall surface of the narrowing member main body 324. In other words, the flow path 326 is formed as a groove having a predetermined width on the end face of the narrowing member main body 324. The narrowing flow path 326 has one end formed to open on the inner peripheral surface of the communication hole 324A and the other end formed to open on the outer peripheral surface of the narrowing member main body 324.

As described above, when the cover 304 is attached to the main body 302, the end face of the narrowing member main body 324 abuts on the main body 302. This causes an opening portion of narrowing flow path 326 formed as a groove on the end face of the narrowing member main body 324 to be blocked by the main body 302. This forms the narrowing flow path 326 so as to open in a direction different from a formation direction of the suction aperture 320A (direction perpendicular to the formation direction of the suction aperture 320A in this example).

As described above, the gripper 306 is arranged in the gripper arrangement area. The gripper 306 has a gripping claw at a tip end thereof so as to pinch the leading end of the paper sheet P to be gripped by the gripping claw.

<Operation>

The image recording drum 300 in this embodiment, which grips the leading end of the paper sheet P by the gripper 306 and holds the paper sheet P by suction on the outer peripheral surface, rotates about an axis to convey the paper sheet P.

Suction of the paper sheet P is carried out by driving the vacuum pump 303. By doing so, an inner side of the sucking part 312 covered by the cover 304 is sucked (brought in to a negative pressure), and the paper sheet P is sucked from the suction apertures 320 formed on the cover 304 such that the paper sheet P is held by suction on the surface of the cover 304 (suction-holding surface).

Here, plenty of the suction apertures 320 for suctioning the paper sheet P are formed on the cover in a predetermined arrangement pattern, a specific suction aperture 320A of which suction apertures has the narrowing member 322 attached thereto as the narrowed suction aperture 320A. The narrowing member 322 has a function to narrow the suction aperture such that the narrowed suction aperture 320A having the narrowing member 322 attached thereto has a suction pressure lower than the non-narrowed suction aperture 320B having no narrowing member 322 attached thereto.

Therefore, by adjusting arrangement of the narrowed suction aperture 320A and non-narrowed suction aperture 320B, the suction pressure can be controlled to be partially higher or lower within the suction-holding surface for holding the paper sheet P by suction. Controlling the suction pressure to be higher or lower allows the suction pressure to be set suitable to the paper sheet P used.

Here, in this example, the non-narrowed suction apertures 320B are arranged in a frame shape so as to be repeatedly arranged on the suction-holding surface with a certain period longitudinally and transversely as shown in FIG. 7.

Such an arrangement has an advantage in a case of holding by suction the paper sheet P which has partially elongation. In other words, the non-narrowed suction apertures 320B having higher suction pressure are arranged in a frame shape such that partial elongation originally involved in the paper sheet P can be trapped in a frame to hold the paper sheet by suction without the partial elongation being accumulated. This allows the paper sheet P to be held by suction without occurrence of creasing even if the paper sheet has partial elongation. In the following description, a description in this regard is given further.

Figure 11A:
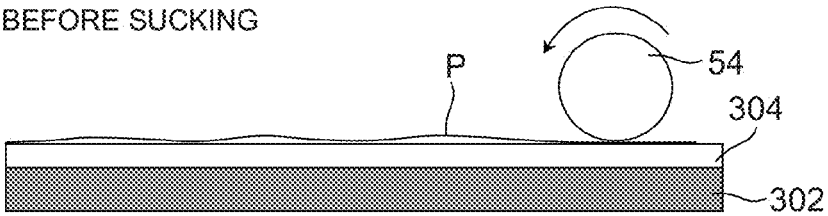
FIG. 11A is an illustration in a case of suctioning a whole surface at an even suction pressure.
Figure 11B:
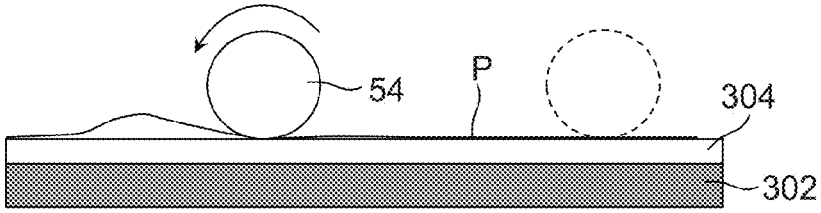
FIG. 11B is another illustration in a case of suctioning a whole surface at an even suction pressure.

FIGS. 11A and 11B each are an illustration in a case of suctioning a whole surface at an even suction pressure.

The paper sheet P held by suction on the suction-holding surface is nipped by the paper pressing roller 54 to improve a degree of contact with the suction-holding surface. However, if a paper sheet having partial elongation is held by suction at an even suction pressure, there may a case where distributed elongation is possibly carried by the paper pressing roller 54 to be accumulated to increase an elongation amount, leading to creasing.

Figure 12A:
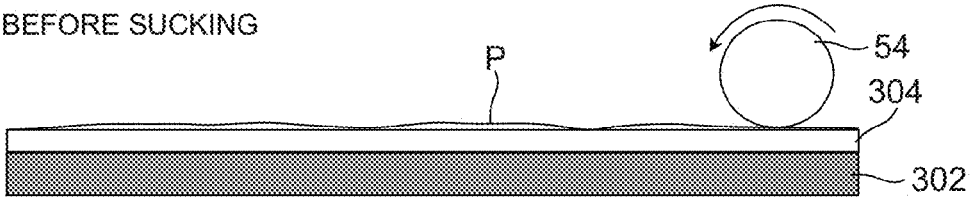
FIG. 12A is an illustration in a case of suctioning with the non-narrowed suction apertures being arranged in a frame.
Figure 12B:
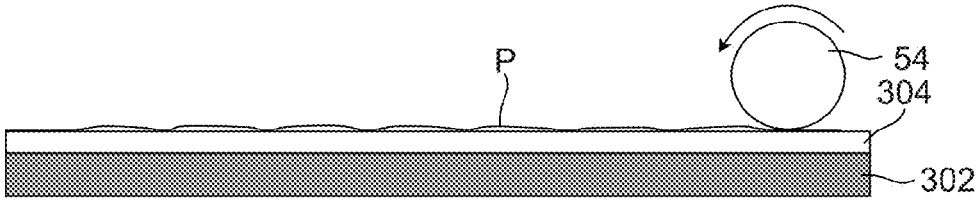
FIG. 12B is another illustration in a case of suctioning with the non-narrowed suction apertures being arranged in a frame.
Figure 12C:
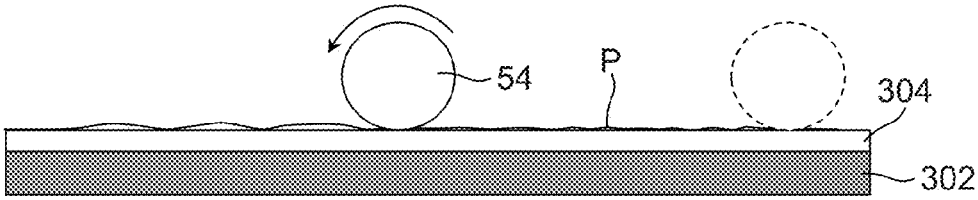
FIG. 12C is another illustration in a case of suctioning with the non-narrowed suction apertures being arranged in a frame.

FIGS. 12A, 12B and 12C each are an illustration in a case of suctioning with the non-narrowed suction apertures being arranged in a frame shape (see FIG. 7).

The non-narrowed suction apertures having higher suction pressure are arranged in a frame shape such that the elongation distributed in the paper sheet P can be divided with an elongation amount being small. This can effectively prevent the occurrence of creasing.

As described above, according to the image recording drum 300 in this embodiment, by adjusting the arrangement of the narrowed suction aperture 320A and non-narrowed suction aperture 320B, the suction pressure can be controlled to be partially higher or lower within the suction-holding surface for holding the paper sheet P by suction to allow the suction pressure to be set suitable to the paper sheet P used.

Since the narrowed suction aperture 320A and the non-narrowed suction aperture 320B can be distinguished from each other by presence or absence of the narrowing member 322, fine suction pressure can be set.

The narrowing member 322 changes the flow path using a portion other than the suction aperture without changing the diameter of the suction aperture, which can make constant a ratio of an area of suction apertures to an area of suction. This facilitates design of suction. In other words, making the suction aperture small affects both a sucking pressure of the aperture itself and an area of sucking, making design of total sucking pressure difficult. However, according to this embodiment, since the flow path is changed using a portion other than the suction aperture without changing the diameter of the suction aperture, only the sucking pressure of the suction aperture itself can be changed, and also a degree of freedom of the arrangement facilitates the design of suction.

<<Another Form of Arrangement of Narrowed Suction Aperture and Non-Narrowed Suction Aperture>>

Figure 13:
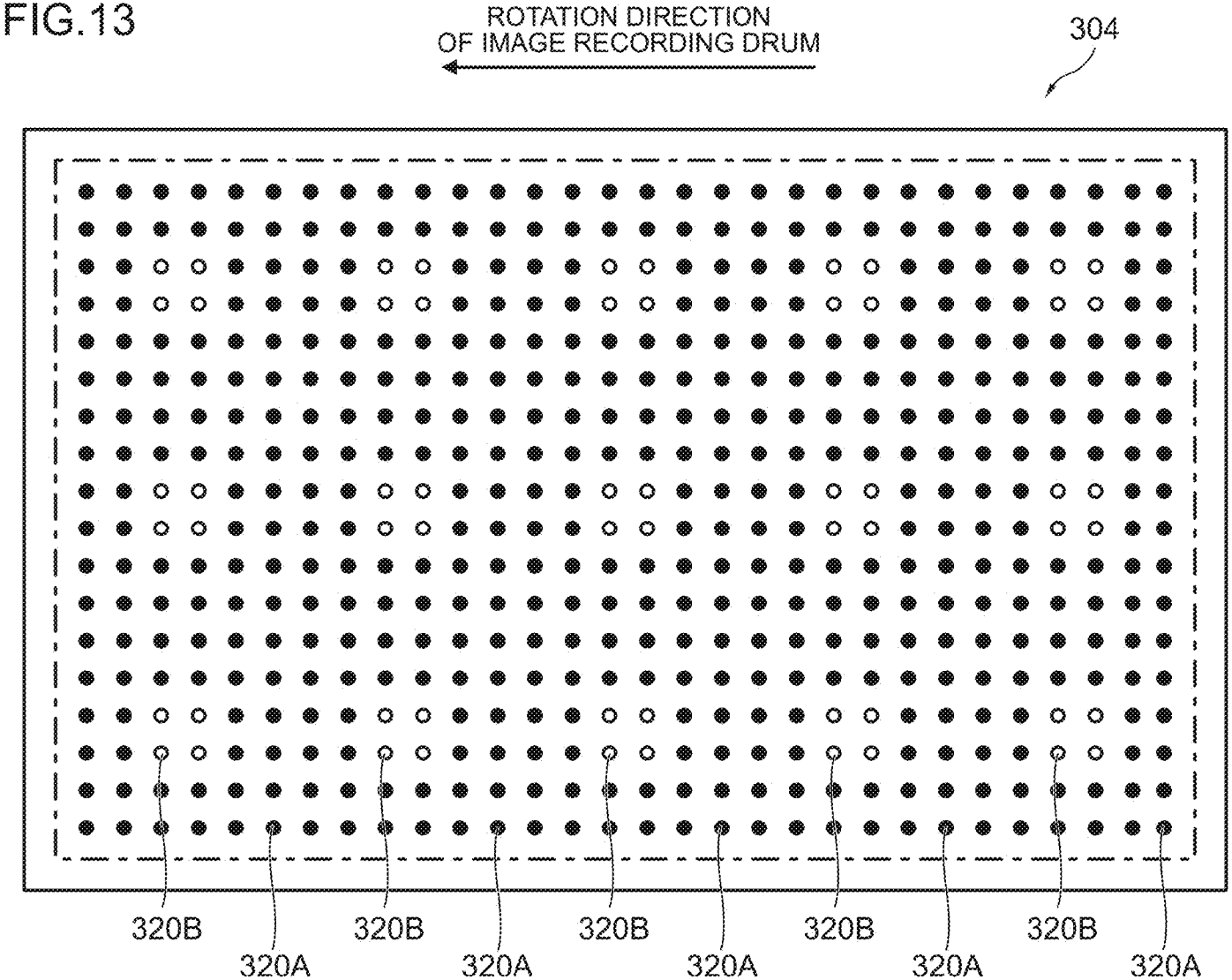
FIG. 13 is a view illustrating another example of a distribution of the narrowed suction apertures and the non-narrowed suction apertures.

FIG. 13 is a view illustrating another example of a distribution of the narrowed suction apertures and the non-narrowed suction apertures.

In the relevant figure, the narrowed suction aperture 320A is expressed by a black circle (●) and the non-narrowed suction aperture 320B is expressed by a while circle (○) for the sake of expediency.

As shown in the relevant figure, in this example, a plurality of clusters (island shapes) of the non-narrowed suction apertures 320B are arranged so as to be repeatedly arranged on the suction-holding surface with a certain period longitudinally and transversely. In other words, plural non-narrowed suction apertures 320B adjacent to one another are set as a cluster, and the clusters of non-narrowed suction apertures 320B are scatteringly arranged.

Also in such a case where the non-narrowed suction apertures 320B having higher suction pressure are arranged in clusters, similar to the above case of the arrangement in a frame shape, the elongation distributed in the paper sheet P can be divided with an elongation amount being small. This can effectively prevent the occurrence of creasing.

Figure 14:
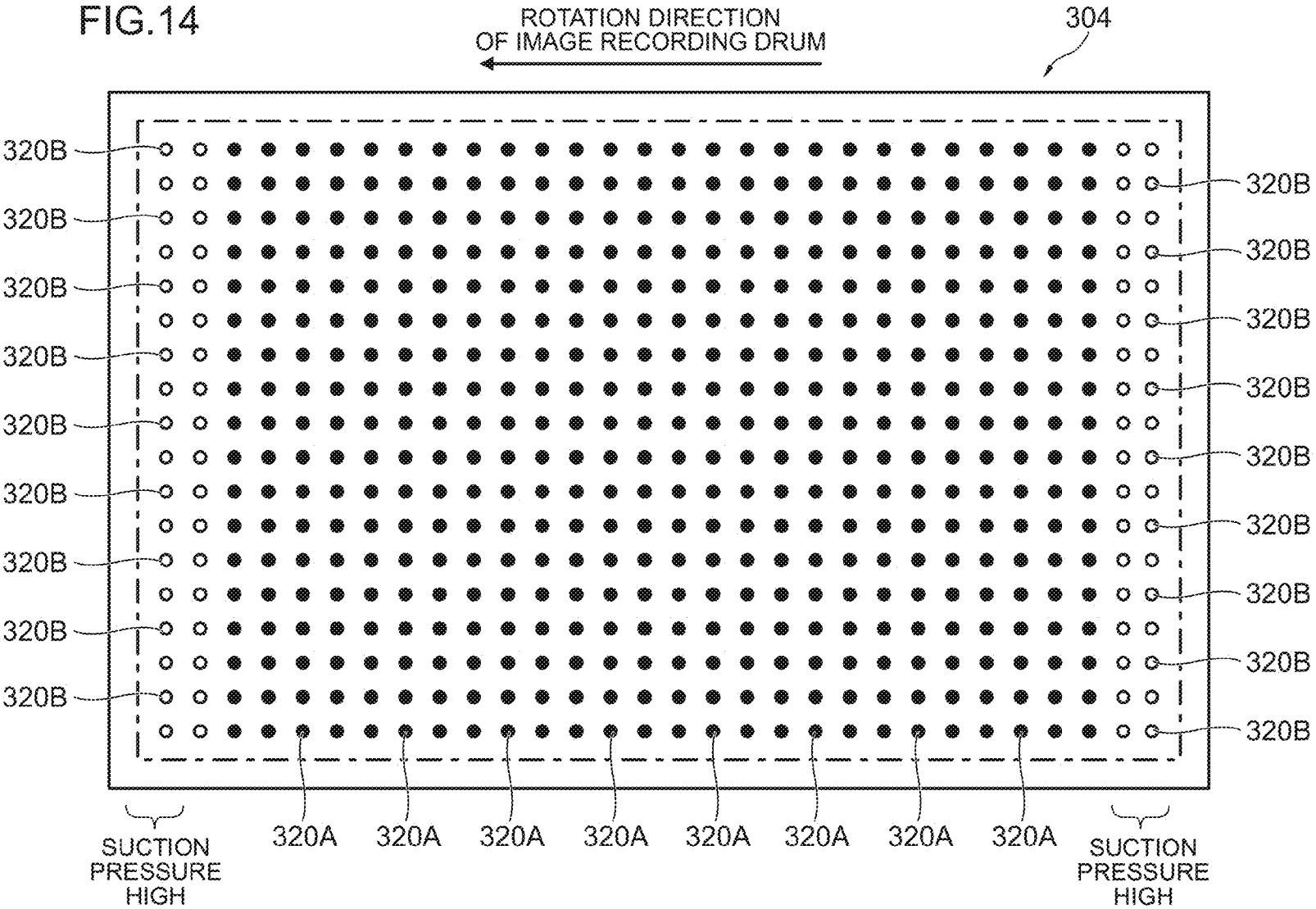
FIG. 14 is a view illustrating another example of a distribution of the narrowed suction apertures and the non-narrowed suction apertures.

FIG. 14 is a view illustrating further another example of a distribution of the narrowed suction apertures and the non-narrowed suction apertures.

In the relevant figure, the narrowed suction aperture 320A is expressed by a black circle (●) and the non-narrowed suction aperture 320B is expressed by a while circle (○) for the sake of expediency.

As shown in the relevant figure, in this example, the non-narrowed suction apertures 320B arranged at a front end part and rear end part of the suction-holding surface with respect to a rotation direction of the image recording drum 300 (conveying direction of the paper sheet P). In other words, the non-narrowed suction apertures 320B having higher suction pressure are configured to be arranged at the front end part and the rear end part with respect to the conveying direction of the paper sheet P.

In this way, arranging the non-narrowed suction apertures 320B having higher suction pressure at the front end part and the rear end part with respect to the conveying direction of the paper sheet P can prevent coming-off at the end parts of the paper sheet P.

Figure 15:
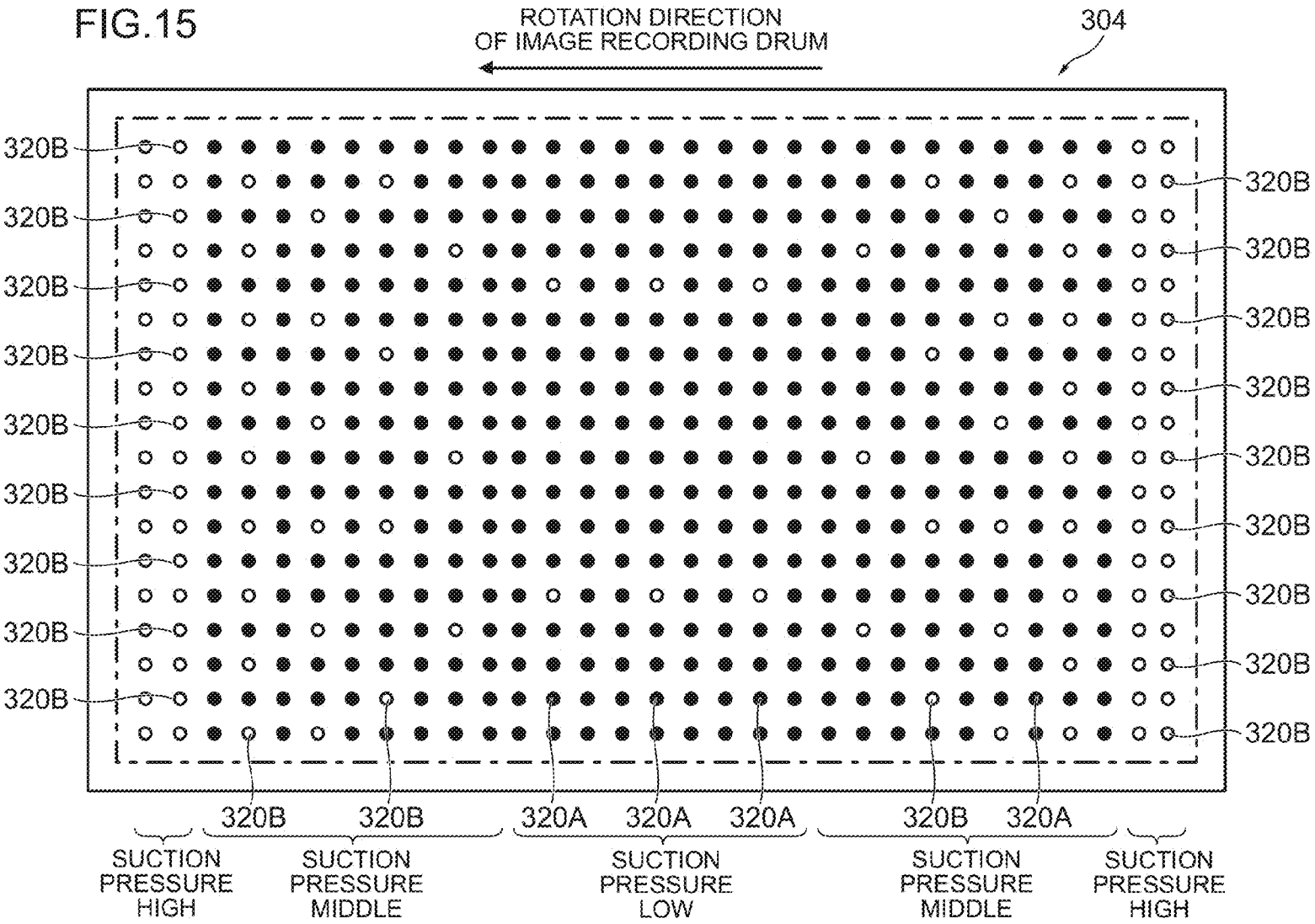
FIG. 15 is a view illustrating another example of a distribution of the narrowed suction apertures and the non-narrowed suction apertures.

The example shown in FIG. 14 is configured to arrange the non-narrowed suction apertures 320B only at the front end part and the rear end part of the suction-holding surface, but the arrangement may be such that the number of the non-narrowed suction apertures 320B is increased stepwise (or successively) from the center of the suction-holding surface toward the front end part and the rear end part as shown in FIG. 15. In other words, the suction pressure may be increased stepwise (or successively) from the center part toward the front end part and the rear end part.

The example shown in FIG. 14 is configured to arrange the non-narrowed suction apertures 320B only at the front end part and the rear end part of the suction-holding surface, but the arrangement may be such that the non-narrowed suction apertures 320B are arranged at the front, rear, right and left end parts. In this case also, the arrangement may be such that the number of the non-narrowed suction apertures 320B is increased stepwise (or successively) from the center toward the front, rear, right and left end parts.

As described above, various arrangement forms of the narrowed suction aperture 320A and the non-narrowed suction aperture 320B may be employed, allowing suction suitable to the paper sheet P by changing the arrangement.

In the image recording drum 300 in the embodiment which has the cover 304 provided detachably to the main body 302, it is preferable that a plurality of covers 304 are prepared and changed for use depending on the paper sheet P which are different in the arrangement of the narrowed suction apertures 320A and the non-narrowed suction apertures 320B.

Note that the embodiment uses a configuration in which the cover 304 is attached to the main body 302 by the cover fixing means including the front end gripping member 308 for gripping the edge of the front end of the cover 304 and the rear end gripping member 310 for gripping the edge of the rear end of cover 304, but the form for detachably attaching the cover 304 to the main body 302 is not limited thereto. For example, the fixing may be made by way of a screw or the like in an embodiment.

<<Another Form of Narrowing Member>>

Figure 16:
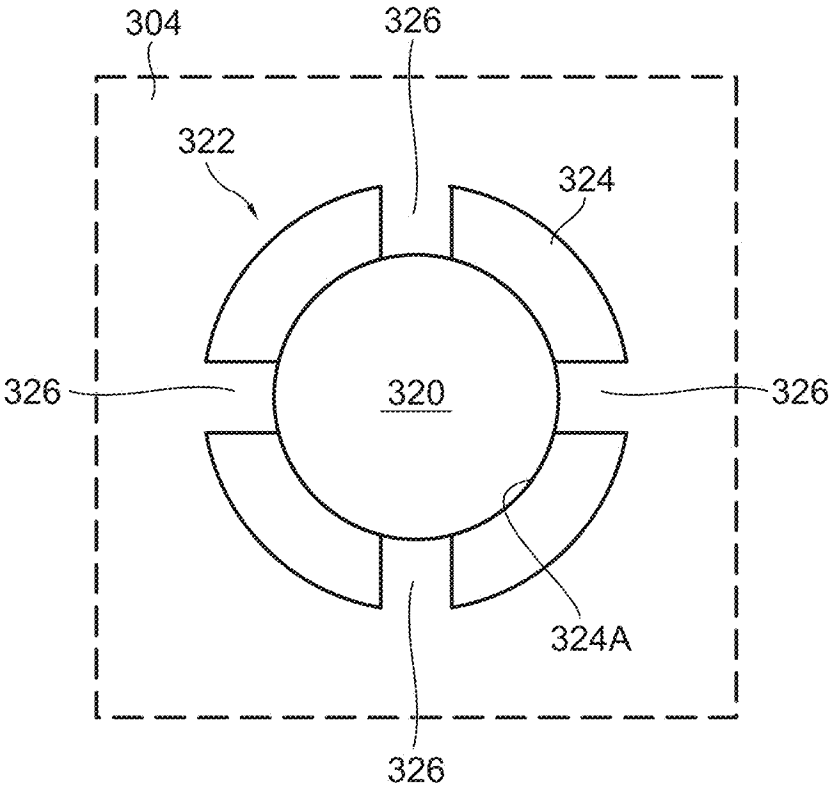
FIG. 16 is a plan view illustrating another form of a narrowing member.

FIG. 16 is a plan view illustrating another form of the narrowing member.

In the above embodiment, the narrowing flow path 326 is formed at only one portion of the narrowing member main body 324, but may be formed at plural portions as shown in FIG. 16.

In the example shown in FIG. 16, four narrowing flow paths 326 each formed as a groove are radially formed. The number of the narrowing flow paths 326 is adjusted to be able to adjust the sucking pressure. In other words, the number of the narrowing flow paths 326 is increased to be able to heighten the sucking pressure.

Figure 17:
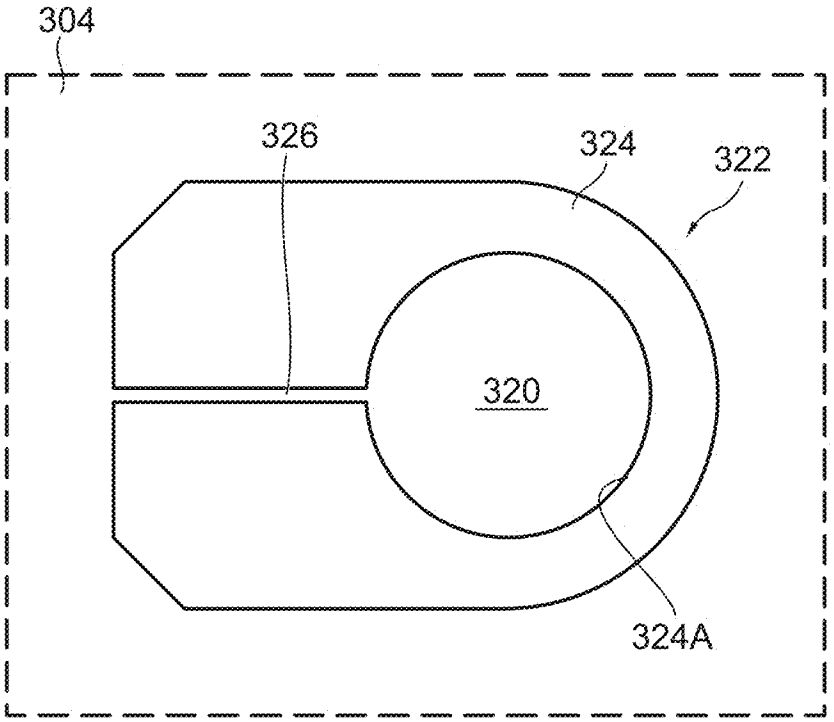
FIG. 17 is a plan view illustrating another form of the narrowing member.

FIG. 17 is a plan view illustrating further another form of the narrowing member.

As shown in the relevant figure, the narrowing member 322 is formed such that a portion where the narrowing flow path 326 of the narrowing member main body 324 is formed is formed so as to protrude in a direction perpendicular to the axial direction of the suction aperture 320 and the narrowing flow path 326 formed as a groove has a length made longer and a width made narrower. In this way, lengthening and narrowing the narrowing flow path 326 allows a narrowing effect to increase.

Figure 18:
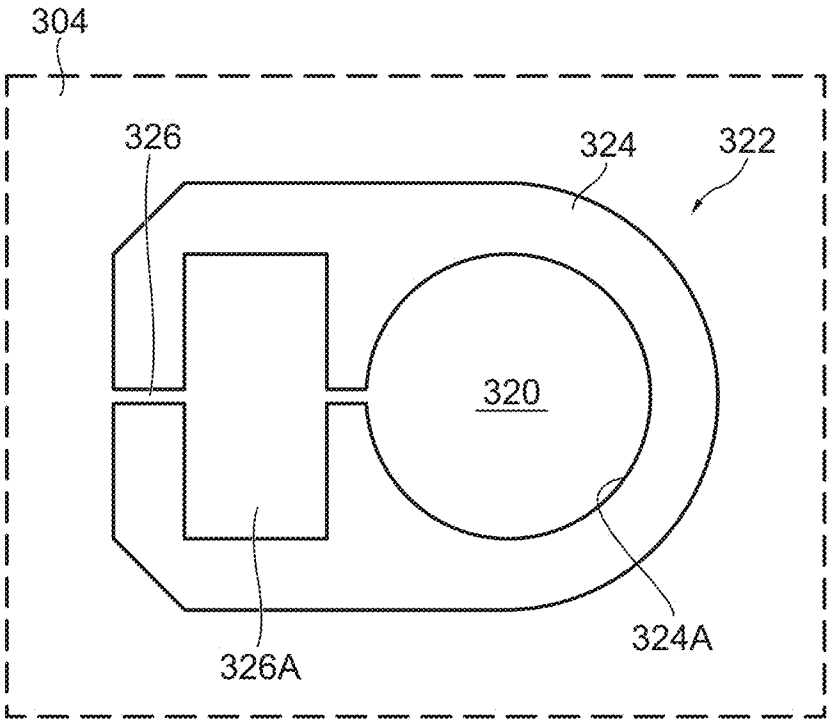
FIG. 18 is a plan view illustrating another form of the narrowing member.

FIG. 18 is a plan view illustrating further another form of the narrowing member.

As shown in the relevant figure, the narrowing member 322 has an expansion part 326A (expansion area) having an expanded width in an intermediate portion of the narrowing flow path 326 formed as a groove as compared with the narrowing member 322 shown in FIG. 17. In this way, providing the expansion part 326A in the middle of the narrowing flow path 326 allows the narrowing effect to increase under a sucking condition of large flow rate due to the orifice effect.

Figure 19:
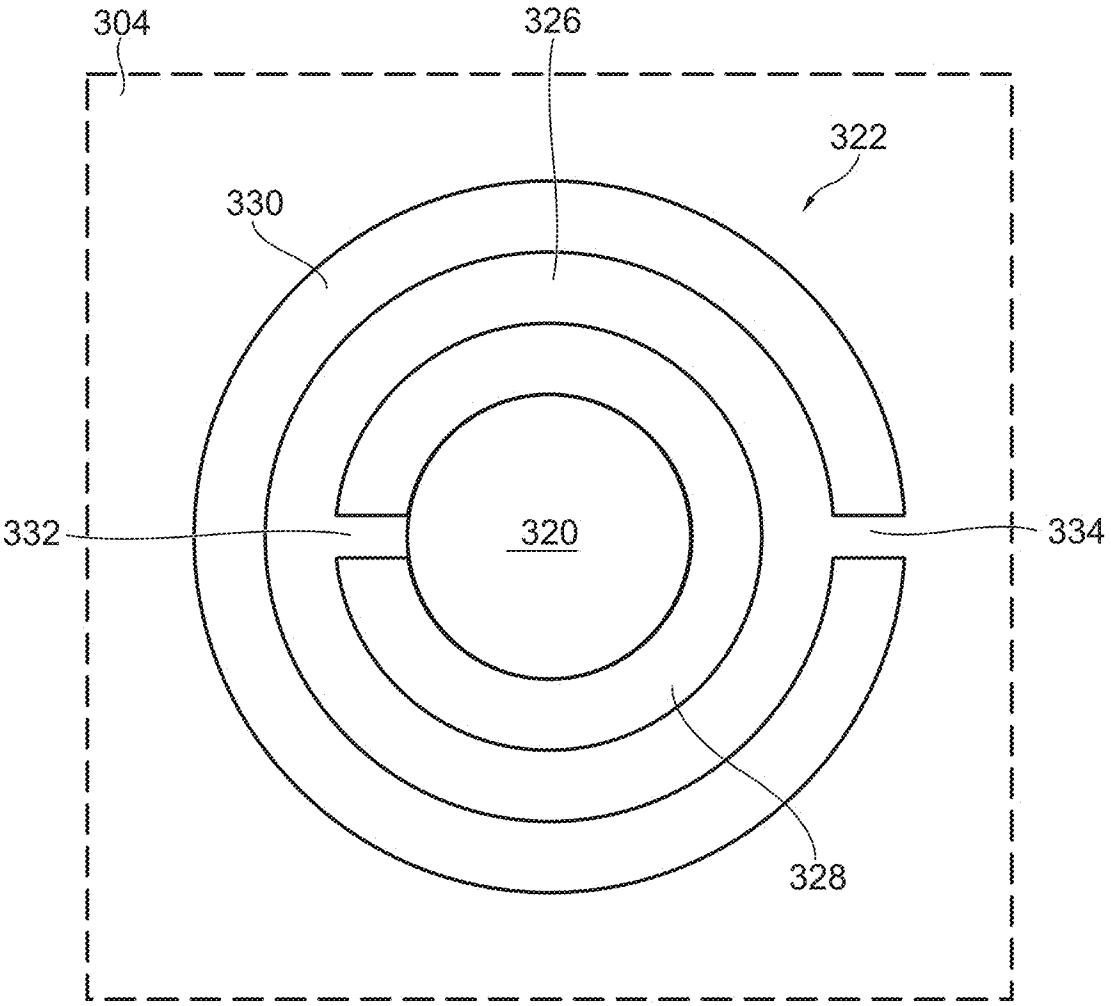
FIG. 19 is a plan view illustrating another form of the narrowing member.

FIG. 19 is a plan view illustrating further another form of the narrowing member.

As shown in the relevant figure, the narrowing member 322 in this aspect has the narrowing member main body 324 formed in a so-called double tube structure. In other words, the narrowing member main body 324 is formed of an inner tubular part 328 and an outer tubular part 330. The inner tubular part 328 on the inner side is formed such that an inner periphery thereof has a diameter the same as the diameter of the suction aperture 320, and is arranged concentrically with the suction aperture 320. The outer tubular part 330 is arranged around an outer periphery of the inner tubular part 328 to define a predetermined gap (flow path) between the outer tubular part 330 and the inner tubular part 328. The inner tubular part 328 has an inner tubular cutout 332 formed on a part of a wall surface thereof, and the outer tubular part 330 also has an outer tubular cutout 334 formed on a part of a wall surface thereof. The inner tubular cutout 332 is formed into a groove shape from an end face of the inner tubular part 328 so as to have one end formed to open on an inner wall surface of the inner tubular part 328 and the other end formed to open on an outer wall surface of the inner tubular part 328. The outer tubular cutout 334 is also formed into a groove shape from an end face of the outer tubular part 330 so as to have one end formed to open on an inner wall surface of the outer tubular part 330 and the other end formed to open on an outer wall surface of the outer tubular part 330. The inner tubular cutout 332 and the outer tubular cutout 334 are formed at positions opposed to each other by 180 degrees. When the cover 304 is attached to the main body 302, ends of the inner tubular part 328 and the outer tubular part 330 abut on the main body 302 which blocks the inner periphery of the inner tubular part 328 and the inner periphery of the outer tubular part 330. At the same time as this, the narrowing flow path 326 is formed between the inner tubular part 328 and the outer tubular part 330.

According to the narrowing member 322 of this aspect, forming the narrowing flow path 326 into in an arc shape can make the narrowing member 322 having high narrowing effect compact.

Any of the above narrowing members 322 is formed such that the narrowing member main body 324 abuts on the main body 302, and has a configuration in which the narrowing flow path 326 opens in a direction perpendicular to an axis of the suction aperture 320. Such a configuration can make the narrowing member 322 function as a supporting part for the cover 304 to prevent the cover 304 from deforming such as bending.

As shown by a series of forms, adjusting the number and shape of the narrowing flow paths of the narrowing member can adjust the narrowing effect. Therefore, a plurality of narrowing members different in the narrowing effect can be combined to be used such that the suction pressure is adjusted in units of suction aperture.

As for the non-narrowed suction aperture, the suction pressure can be heightened by forming a counter bored groove on the cover back surface. Therefore, the non-narrowed suction apertures having the counter bored groove can also be combined such that the suction pressure is adjusted in units of suction aperture.

<<Another Form of Main Body>>

In the above embodiment, the main body is formed into a drum shape, and the configuration in which the paper sheet is held by suction on the peripheral surface of the main body and the configuration in which the main body is rotated to convey the paper sheet (so-called drum conveyance) are used, but the configuration of the main body is not limited thereto.

For example, the main body may be configured to include a belt having no ends, and a configuration in which a cover is attached to the peripheral surface of the belt having no ends to hold the paper sheet by suction and a configuration in which the belt having no ends runs to convey the paper sheet may also be used.

In addition, for example, the main body may be configured to include a plate, and a configuration in which a cover is attached to a surface of the plate to hold the paper sheet by suction and a configuration in which the plate moves to convey the paper sheet may also be used.

<<Another Form of Medium>>

In the above embodiment, a description is given of a case where a paper sheet as a medium is held by suction to be conveyed, but the medium is not limited thereto. The medium may only be a sheet-shaped medium. Therefore, for example, the embodiment may be used to hold by suction various types of media, irrespective of material and size, such as continuous paper, cut paper, sealed paper, resin sheets, such as OHP sheets, film, cloth, a printed circuit board on which a wiring pattern, or the like, is formed, and an intermediate transfer medium, and the like.

<<Another Form of Suction Apertures Arrangement>>

Figure 20:
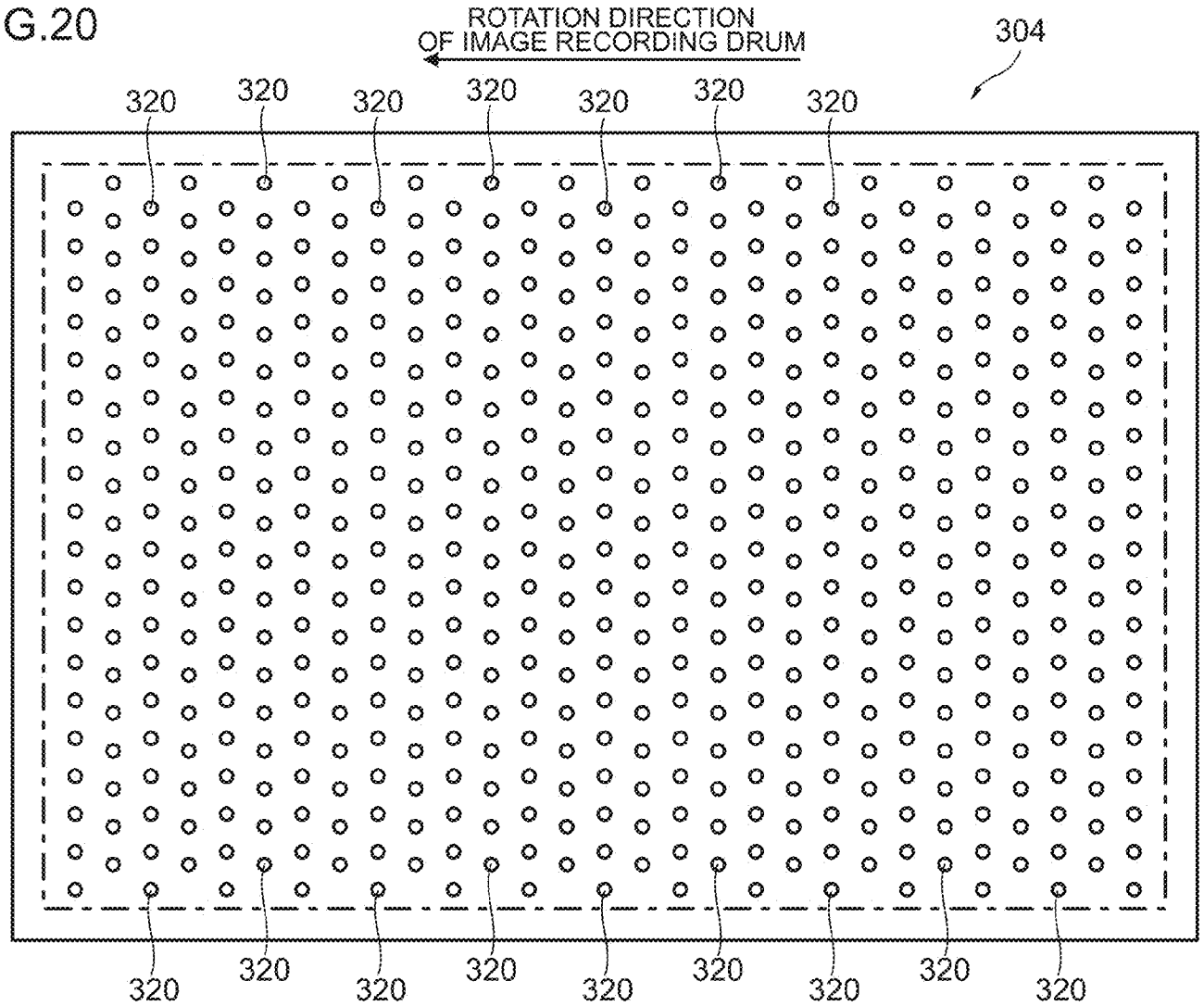
FIG. 20 is a plan view illustrating another form of the suction apertures arrangement.

In the above embodiment, on the peripheral surface of the image recording drum 300, the suction apertures 230 are arranged at a certain pitch horizontally and vertically, but the arrangement of the suction apertures 320 is not limited thereto. For example, as shown in FIG. 20, a configuration in which the suction apertures 230 are arranged to be shifted alternately every one row with respect to the conveying direction of the image recording drum 300 may be used. In addition to this, a configuration in which the suction apertures are arranged to be periodically repeated in a regular pattern longitudinally and transversely may also be used.

As for the non-narrowed suction aperture 320B also, in a case of the arrangement in a certain pattern, the suction apertures are not necessarily arranged repeatedly with a certain period and may be configured to be arranged with a predetermined period (period depending on the location and the like).

What is claimed is:

1. A medium-holding device holding a sheet-shaped medium by suction, comprising:

a main body having a sucking part;

a sucking device which sucks an inner side of the sucking part;

a sheet-shaped cover which is attached to the main body and covers the sucking part to configure a suction-holding surface of the medium;

a plurality of suction apertures formed to have the same diameter on the cover; and a narrowing member individually provided to a specific suction aperture of the plurality of suction apertures and for narrowing the specific suction aperture, the narrowing member including a narrowing flow path which is provided on a back surface of the cover and in communication with the specific suction aperture to narrow the specific suction aperture, wherein the narrowing member abuts on the main body when the cover is attached to the main body, wherein the narrowing member includes:

a narrowing member main body having an abutment face on which the main body abuts;

a communication hole formed to penetrate from the abutment face of the narrowing member main body to the specific suction aperture and formed concentrically with the specific suction aperture to have a diameter the same as the specific suction aperture; and a groove formed on the abutment face of the narrowing member main body and having one end formed to open on an outer peripheral surface of the narrowing member main body and the other end formed to open on an inner peripheral surface of the communication hole, wherein the abutment face of the narrowing member main body abuts on the main body such that an opening portion of the communication hole formed on the abutment face is blocked by the main body, and the narrowing flow path is defined by an opening portion of the groove formed on the abutment face and the main body.

2. The medium-holding device according to claim 1, wherein the narrowing flow path of the narrowing member is formed to open in a direction different from a formation direction of the specific suction aperture.

3. The medium-holding device according to claim 1, wherein a plurality of the grooves are formed radially from the communication hole as a center.

4. The medium-holding device according to claim 1, wherein the groove has an expansion area having an expanded width in an intermediate portion thereof.

5. The medium-holding device according to claim 1, wherein the cover is detachably attached to the main body.

6. The medium-holding device according to claim 5, wherein a plurality of the covers different from each other in the arrangement of the specific suction apertures are provided in advance.

7. The medium-holding device according to claim 1, wherein the suction apertures are arranged longitudinally and transversely on the suction-holding surface, and the suction apertures other than the specific suction aperture are repeatedly arranged longitudinally and transversely on the suction-holding surface.

8. The medium-holding device according to claim 7, wherein the suction apertures other than the specific suction aperture are arranged in a frame shape and repeatedly arranged longitudinally and transversely on the suction-holding surface.

9. The medium-holding device according to claim 7, wherein the suction apertures other than the specific suction aperture are arranged in clusters and repeatedly arranged longitudinally and transversely on the suction-holding surface.

10. The medium-holding device according to claim 1, wherein the suction apertures are arranged longitudinally and transversely on the suction-holding surface, and the suction apertures other than the specific suction aperture are arranged at both end parts in a longitudinal direction and/or a transverse direction on the suction-holding surface.

11. The medium-holding device according to claim 1, wherein the suction apertures are arranged longitudinally and transversely on the suction-holding surface, and the suction apertures other than the specific suction aperture are arranged a ratio of which is increased stepwise from the center of the suction-holding surface toward both end parts in a longitudinal direction and/or a transverse direction on the suction-holding surface.

12. The medium-holding device according to claim 1, further comprising a roller rolling and moving relatively on the suction-holding surface to nip the medium held by suction by the suction-holding surface between the roller and the suction-holding surface.

13. A medium-conveying device, comprising:

the medium-holding device according to claim 1, and a driving device which drives the main body of the medium-holding device to move the suction-holding surface.

14. The medium-conveying device according to claim 13, wherein the main body is formed into a drum shape, and the suction-holding surface is formed on the outer peripheral surface.

15. An inkjet recording device, comprising:

the medium-conveying device according to claim 13; and an inkjet head ejecting and depositing an ink toward the medium being conveyed by the medium-conveying device to render an image on the medium.

16. A medium-holding device holding a sheet-shaped medium by suction, comprising:

a main body having a sucking part;

a sucking device which sucks an inner side of the sucking part;

a sheet-shaped cover which is attached to the main body and covers the sucking part to configure a suction-holding surface of the medium;

a plurality of suction apertures formed to have the same diameter on the cover; and a narrowing member individually provided to a specific suction aperture of the plurality of suction apertures and for narrowing the specific suction aperture, the narrowing member including a narrowing flow path which is provided on a back surface of the cover and in communication with the specific suction aperture to narrow the specific suction aperture, wherein the narrowing member abuts on the main body when the cover is attached to the main body, wherein the narrowing member includes:

a tubularly-shaped inner tubular part arranged concentrically with the specific suction aperture in which an inner periphery has a diameter the same as the specific suction aperture, and the inner periphery is in communication with the specific suction aperture;

an inner tubular cutout formed by cutting out a part of a wall surface of the inner tubular part;

a tubularly-shaped outer tubular part arranged concentrically with the inner tubular part in which an inner periphery has a diameter larger than an outside diameter of the inner tubular part, and a certain gap is defined between the outer tubular part and the inner tubular part; and an outer tubular cutout formed by cutting out a part of a wall surface of the outer tubular part, wherein end faces of the inner tubular part and the outer tubular part abut on the main body such that the inner periphery of the inner tubular part and the inner periphery of the outer tubular part are blocked by the main body, and the narrowing flow path is defined between the inner tubular part and the outer tubular part.

* * * * *